US012065227B2

(12) United States Patent
Njaka et al.

(10) Patent No.: US 12,065,227 B2
(45) Date of Patent: Aug. 20, 2024

(54) HIGH-SPEED OMNIDIRECTIONAL UNDERWATER PROPULSION MECHANISM

(71) Applicant: VIRGINIA TECH INTELLECTUAL PROPERTIES, INC., Blacksburg, VA (US)

(72) Inventors: Taylor Njaka, Blacksburg, VA (US); Pinhas Ben-Tzvi, Blacksburg, VA (US); Stefano Brizzolara, Blacksburg, VA (US)

(73) Assignee: VIRGINIA TECH INTELLECTUAL PROPERTIES, INC., Blacksburg, VA (US)

( * ) Notice: Subject to any disclaimer, the term of this patent is extended or adjusted under 35 U.S.C. 154(b) by 333 days.

(21) Appl. No.: 17/531,007

(22) Filed: Nov. 19, 2021

(65) Prior Publication Data

US 2022/0388617 A1 Dec. 8, 2022

Related U.S. Application Data

(60) Provisional application No. 63/116,380, filed on Nov. 20, 2020.

(51) Int. Cl.

| | |
|---|---|
| ***B63H 1/26*** | (2006.01) |
| ***B63B 39/00*** | (2006.01) |
| ***B63H 21/21*** | (2006.01) |

(52) U.S. Cl.

CPC ..... *B63H 1/26* (2013.01); *B63B 39/00* (2013.01); *B63H 21/21* (2013.01); *B63H 2021/216* (2013.01)

(58) Field of Classification Search

CPC .... B63H 1/26; B63H 21/21; B63H 2021/216; B63B 39/00

See application file for complete search history.

(56) References Cited

U.S. PATENT DOCUMENTS

2014/0091172 A1* 4/2014 Arlton ..... B64C 27/10 244/17.23
2017/0036746 A1* 2/2017 MacCready ..... B63G 8/16

FOREIGN PATENT DOCUMENTS

WO WO-2011123758 A1 * 10/2011 ..... G05D 1/102

OTHER PUBLICATIONS

Akva, "World's fastest ROV?—Project ROST," 2018. [Online]. Available: https://www:akvagroup:com/news/news-archive/news-view/world-s-fastest-rov-project-rost.

(Continued)

*Primary Examiner* — Stephen P Avila
(74) *Attorney, Agent, or Firm* — Perilla Knox & Hildebrandt LLP; Jason M. Perilla

(57) ABSTRACT

Various examples of a high-speed omnidirectional fully-actuated underwater propulsion mechanism are described. In one example, a propulsion system includes two decoupled counter-rotating rotors centered on a main axis, with each rotor comprising a plurality of pivotable blades projecting radially from the main axis, a servo-swashplate actuation mechanism comprising a plurality of servos and a linkage assembly connected from the servos to the pivotable blades, a blade-axis re-enforcing flap adapter comprising a plurality of stationary flaps, with the blade-axis re-enforcing flap adapter being positioned in a region between the two decoupled counter-rotating rotors centered on the main axis, and a controller. The controller can be configured to calculate control parameters, compensate a first control parameter among the control parameters to reduce cross-coupling of an unwanted force generated by drag forces on the two decoupled counter-rotating rotors, and generate a control signal for each of the servos based on the control parameters.

20 Claims, 14 Drawing Sheets

(56) References Cited

OTHER PUBLICATIONS

Botella, et al., An Overview of the LS-STAG Immersed Boundary Method for Viscous Incompressible Flows. In Computational Fluid Dynamics, 2010.
Chikh, MEROS Project Technical Advances in Modeling and Control. No. Feb. 2013.
Chocron et al., A validated feasibility prototype for AUV reconfigurable magnetic coupling thruster, IEEE/ASME Transactions on Mechatronics, vol. 19, No. 2, pp. 642-650, 2014.
Concli et al., Windage power losses of ordinary gears: Different CFD approaches aimed to the reduction of the computational effort, Lubricants, vol. 2, No. 4, pp. 162-176, 2014.
Eastwick et al., Gear windage: A review, Journal of Mechanical Design, Transactions of the ASME, vol. 130, No. 3, pp. 1-6, 2008.
Eidsvik et al., Determination of Hydrodynamic Parameters for Remotely Operated Vehicles, In vol. 7: Ocean Engineering, NTNU, p. V007T06A025, 2016.
Gamazo-Real et al., Position and speed control of brushless dc motors using sensorless techniques and application trends, Sensors, vol. 10, No. 7, pp. 6901-6947, 2010.
Goudey et al., A Second Generation Survey AUV, Proceedings AUV '94, pp. 148-155, 1994.
Hoerner et al., Hydrofoil Handbook. Volume I, Design of Hydrofoil Craft, 1954.
Kepler et al., Assessment of AUV Hydrodynamic Coefficients from Analytic and Semi-Empirical Methods, In Oceans, 2018.
Leishman, Principles of Helicopter Aerodynamics, 2nd ed. New York: Cambridge University Press, 2006.
McColgan et al., Coordination of Multiple Biomimetic Autonomous Underwater Vehicles Using Strategies Based on the Schooling Behaviour of Fish, Robotics, 5(1), 1, p. 1-23, Jan. 13, 2016.
Maloof et al., A Brushless Electric Propulsion System for the Research Submersible Alvin, In IEEE/MTS Oceans '86, 1986.
Mazumdar et al., Control-configured design of spheroidal, appendage-free, underwater vehicles, IEEE Transactions on Robotics, vol. 30, No. 2, pp. 448-460, Apr. 2014.
Njaka et al., Design and Simulation of a Fully-Actuated Underwater Propulsion Mechanism, in Proceedings of the 2019 ASME IDETC/CIE, Anaheim, CA, 2019, p. 97534.
Njaka et al., CFD Investigation of Hull-Rudder Interaction for Improved Maneuvering Models, in SNAME Maritime Convention 2019, SMC 2019.
Service., U. S. F. S., 1978. Basic helicopter handbook. Superintendent of Documents.
Shi et al., Advanced control in marine mechatronic systems: A survey, IEEE/ASME Transactions on Mechatronics, vol. 22, No. 3, pp. 1121-1131, Jun. 2017.
Tanakitkorn et al., Depth control for an over-actuated, hover-capable autonomous underwater vehicle with experimental verification, Mechatronics, vol. 41, pp. 67-81, 2017.
Wernli, The Present and Future Capabilities of Deep ROVs, Marine Technology Society Journal, 33(4), 1, pp. 26-40, 1999.
Woud et al., Chapter 3 Propulsion and Electric Power, in Design of Propulsion and Electric Power Generation Systems London: IMarEST, 2002, ch. Chapter 3.
Yang et al., Underwater Modeling, Experiments and Control Strategies of FroBot, IEEE International Conference on Intelligent Robots and Systems, pp. 6397-6403, 2018.
UIUC Airfoil Coordinates Database Source dat file; airfoiltools.com/airfoil/details?airfoil=fx76100-il, downloaded Feb. 28, 2022.

* cited by examiner

HIGH-SPEED OMNIDIRECTIONAL UNDERWATER PROPULSION MECHANISM

CROSS-REFERENCE TO RELATED APPLICATION

This application claims the benefit of and priority to U.S. Provisional Application No. 63/116,380, titled "HIGHLY-AGILE OMNIDIRECTIONAL FULLY-ACTUATED UNDERWATER PROPULSION MECHANISM," filed on Nov. 20, 2020, the entire contents of which are hereby incorporated herein by reference.

BACKGROUND

Submersibles are watercraft designed to operate under water. Traditional autonomous underwater vehicles are used primarily for underwater mapping and survey applications. Another class of submersibles includes remotely operated vehicles used primarily for inspection and intervention and are capable of more complex tasks.

BRIEF DESCRIPTION OF THE DRAWINGS

Many aspects of the present disclosure can be better understood with reference to the following drawings. The components in the drawings are not necessarily drawn to scale, with emphasis instead being placed upon clearly illustrating the principles of the disclosure. In the drawings, like reference numerals designate corresponding parts throughout the several views.

DETAILED DESCRIPTION

Figure 1:
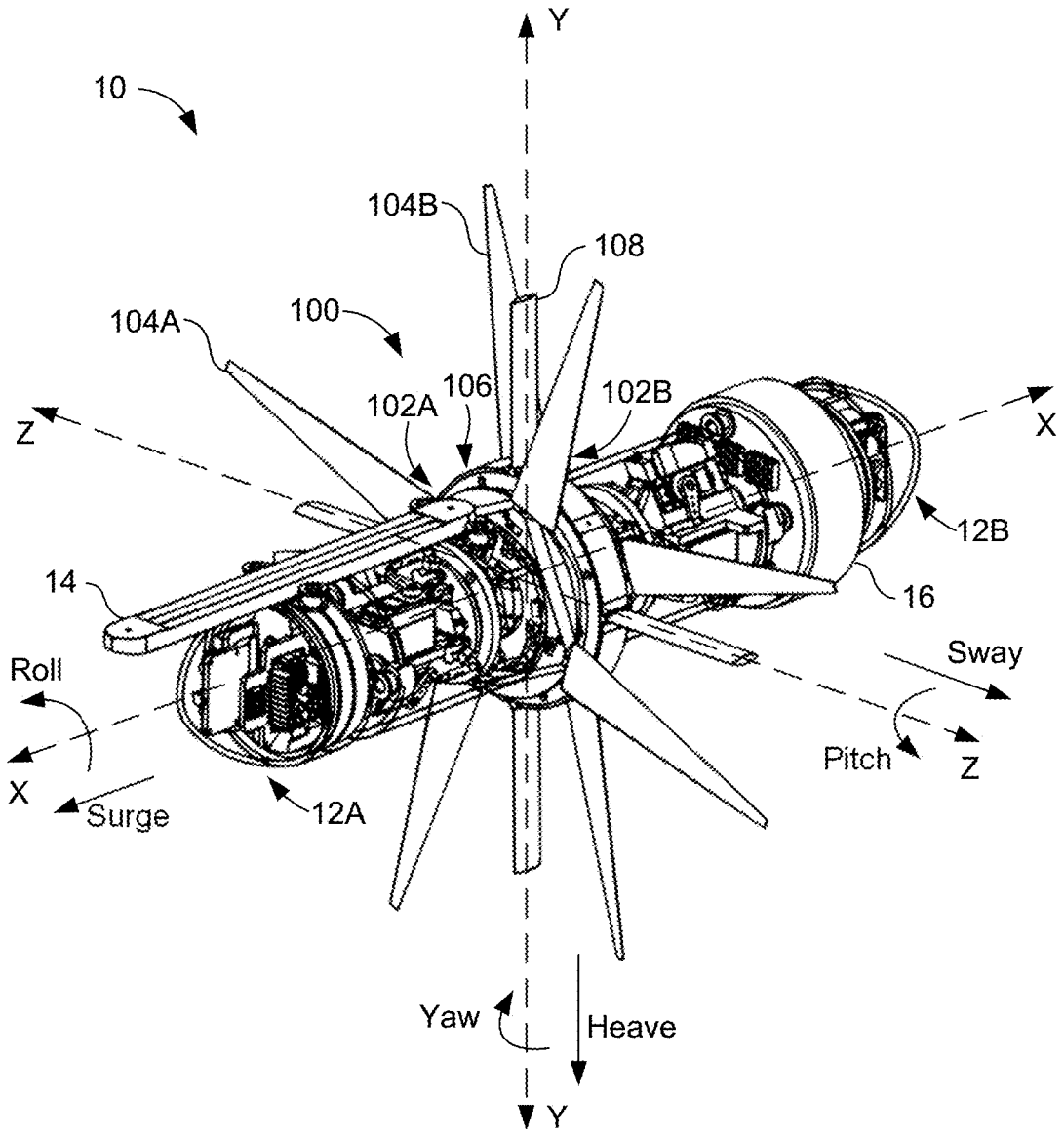
FIG. 1 illustrates an example of an unmanned underwater vehicle having a high-speed omnidirectional underwater propulsion mechanism according to various embodiments described herein.

Long has there been a divide between the class of submersibles composed of streamlined, torpedo-shaped vehicles (autonomous underwater vehicles (AUVs)) and that of omnidirectional or semi-omnidirectional crafts resembling the famous ALVIN submersible (remotely operated vehicles (ROVs)). Crafts such as the latter are capable of complex tasks involving external manipulation but are lethargic in nature and prone to flow-based disturbances, as found in shallow waters at stormy conditions or in turbulent tidal environments near artificial piers. There exists a need for an unmanned underwater vehicle (UUV) which combines the speed and agility of AUVs with the full-omnidirectional capability and precision of ROVs. Such a vehicle could potentially operate in conditions unreachable by the other two vehicle classes, while reducing the total operating time and thereby the financial and strategic cost for deployment in ROV-specific applications.

The growing interest in robots replacing humans in turbulent, potentially dangerous environments where precision, speed, and robustness are necessary has inspired the development of a new class of underwater robotic thrust mechanism capable of true agile omnidirectionality in a compact design, including the designs described herein. Challenges include but are not limited to minimizing reaction time to position disturbances, which is hindered by the delay of accelerating water and the thrust-to-mass ratio of any smaller craft attempting to actively reject disturbance. For large crafts, resilience to disturbances is inherent in vehicle mass, but fast position control is not practical. In much smaller crafts, fast position control is possible but delayed by the acceleration time of traditional ducted thrusters, making their inherent susceptibility to disturbances difficult to overcome.

Traditional AUVs are high-speed, underactuated flight vehicles used primarily for underwater mapping and survey applications. Omnidirectional ROVs, on the other hand, are used primarily for inspection and intervention. ROVs can have a zero-turning radius benefit that results from their omnidirectionality, but suffer greatly in maximum speed and agility, where agility can be measured as the potential for instantaneous acceleration on demand. This is quantified by dividing maximum thrust by the sum of mass and added mass, where added mass is the virtual added mass created by fluid momentum around an accelerating body. The high-speed omnidirectional underwater propulsion mechanism disclosed herein possesses the speed capabilities of traditional AUVs while maintaining the zero-turning radius of omnidirectional ROVs. With its omnidirectionality and ability to carry and manipulate a payload, the high-speed omnidirectional underwater propulsion mechanism is perhaps better classified with ROVs. Its high-power consumption also bolsters this classification, as it would require a tether for missions exceeding 15 minutes.

In the context outlined above, various examples of a high-speed omnidirectional underwater propulsion mechanism disclosed herein. The high-speed omnidirectional underwater propulsion mechanism is configured to overcome the aforementioned limitations of traditional AUVs and ROVs. The high-speed omnidirectional underwater propulsion mechanism is configured to decouple blade-pitch actuator loads from rotor torques and forces while exploiting properties of already-moving water to eliminate the delay between actuator action and force output. Such high agility and reaction time can allow the craft to not only react to but actively reject various types of disturbances. The high-speed omnidirectional underwater propulsion mechanism can provide ability for a submersible to vector thrust within its low profile and still control tremendous power can provide exceptional maneuverability. The capabilities were demonstrated using a small-scale prototype was designed around Bullard Pull conditions for omnidirectionality, to be equally responsive along any two opposite directions.

The high-speed omnidirectional underwater propulsion mechanism includes a novel position control mechanism for marine operations or inspection in extreme, hostile, or high-speed turbulent environments where unprecedented speed and agility is described. The omnidirectional mechanism consists of a set of counter-rotating blades operating at frequencies high enough to dampen vibrational effects on onboard sensors. Each rotor is individually powered to allow for roll control via relative motor effort and attached to a servo-swashplate mechanism, enabling quick and powerful manipulation of fluid flow direction in the coordinate frame of the hull without the need to track rotor position. The mechanism inherently severs blade loads from servo torques, putting all load on the main motors and minimizing servo response time, while exploiting consistent blade momentum to minimize the corresponding force response time. Kinematic and hydrodynamic analyses of the hull and surrounding fluid forces during various blade maneuvers are presented, followed by the mechanical design and kinematic analysis of each subsystem in a small scale model.

Described below are various embodiments of the present systems and methods for a high-speed omnidirectional underwater propulsion mechanism therefor. Although particular embodiments are described, those embodiments are mere exemplary implementations of the system and method. One skilled in the art will recognize other embodiments are possible. All such embodiments are intended to fall within the scope of this disclosure. Moreover, all references cited herein are intended to be and are hereby incorporated by reference into this disclosure as if fully set forth herein. While the disclosure will now be described in reference to the above drawings, there is no intent to limit it to the embodiment or embodiments disclosed herein. On the contrary, the intent is to cover all alternatives, modifications and equivalents included within the spirit and scope of the disclosure.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

In the following discussion, a general description of the systems of the present disclosure and their components is provided, followed by a discussion of the operation of the same. Various non-limiting examples of a high-speed omnidirectional underwater propulsion mechanism are discussed.

Shown in FIG. 1 is an example of a UUV 10 comprising a high-speed omnidirectional underwater propulsion mechanism 100. The high-speed omnidirectional underwater propulsion mechanism 100, which will be described in further detail, can include two counter rotating rotors 102A and 102B (collectively "rotors 102"). The rotor 102A includes a plurality of pivotable blades 104A projecting radially, and the rotor 102B includes a plurality of pivotable blades 104B. The UUV 10 also includes a blade-axis re-enforcing flap adapter 106 comprising a plurality of stationary flaps 108 and positioned between the counter rotating rotors 102A and 102B. As an omnidirectional vessel, the UUV 10 can move in any direction underwater, regardless of orientation. An example axis system is shown to further describe the relative orientation of the high-speed omnidirectional underwater propulsion mechanism 100 and/or UUV 10 as further described herein. For example, the high-speed omnidirectional underwater propulsion mechanism 100 is positioned about the main axis (X). The Y-axis and Z-axis are shown for orientation in describing the control of the high-speed omnidirectional underwater propulsion mechanism 100 in six degrees of freedom. As shown, the six degrees of freedom include three translational directions, including surge, sway, and heave, and three rotational directions, including roll, pitch, and yaw.

The UUV 10 can include nose attachments 12A and 12B positioned along a main axis (X) on one or both ends of the UUV 10. For example, the nose attachments 12A and 12B can be configured to house electronics and other components such as sensors, power-electronics, power units, electronic speed controllers, and a controller for the high-speed omnidirectional underwater propulsion mechanism 100. In some examples, the equipment housed within at least one of the nose attachments 12A and 12B can be electronically coupled with and configured to operate the high-speed omnidirectional underwater propulsion mechanism 100. In some examples, the equipment housed within the at least one of the nose attachments 12A or 12B is configured to collect information via one or more sensors and communicate information collected to at least one computer located on a main watercraft or some other remote location.

The UUV 10 can also include external sensors and/or probes positioned exterior to the electronics hull and/or hull of the high-speed omnidirectional underwater propulsion mechanism 100. For example, as shown in FIG. 1, the UUV 10 can be configured with a side-scan sonar 14. In some examples, the UUV 10 can include a tether power conversion unit 16 configured to be connected with a main watercraft for external power. In some examples, the UUV 10 can be powered by an on-board power unit such as one or more batteries, bulk capacitors, and the like. Although the UUV 10 is shown in FIG. 1 is one example of a submersible, the high-speed omnidirectional underwater propulsion mechanism 100 can be relied on for used in other submersible configurations.

Figure 2:
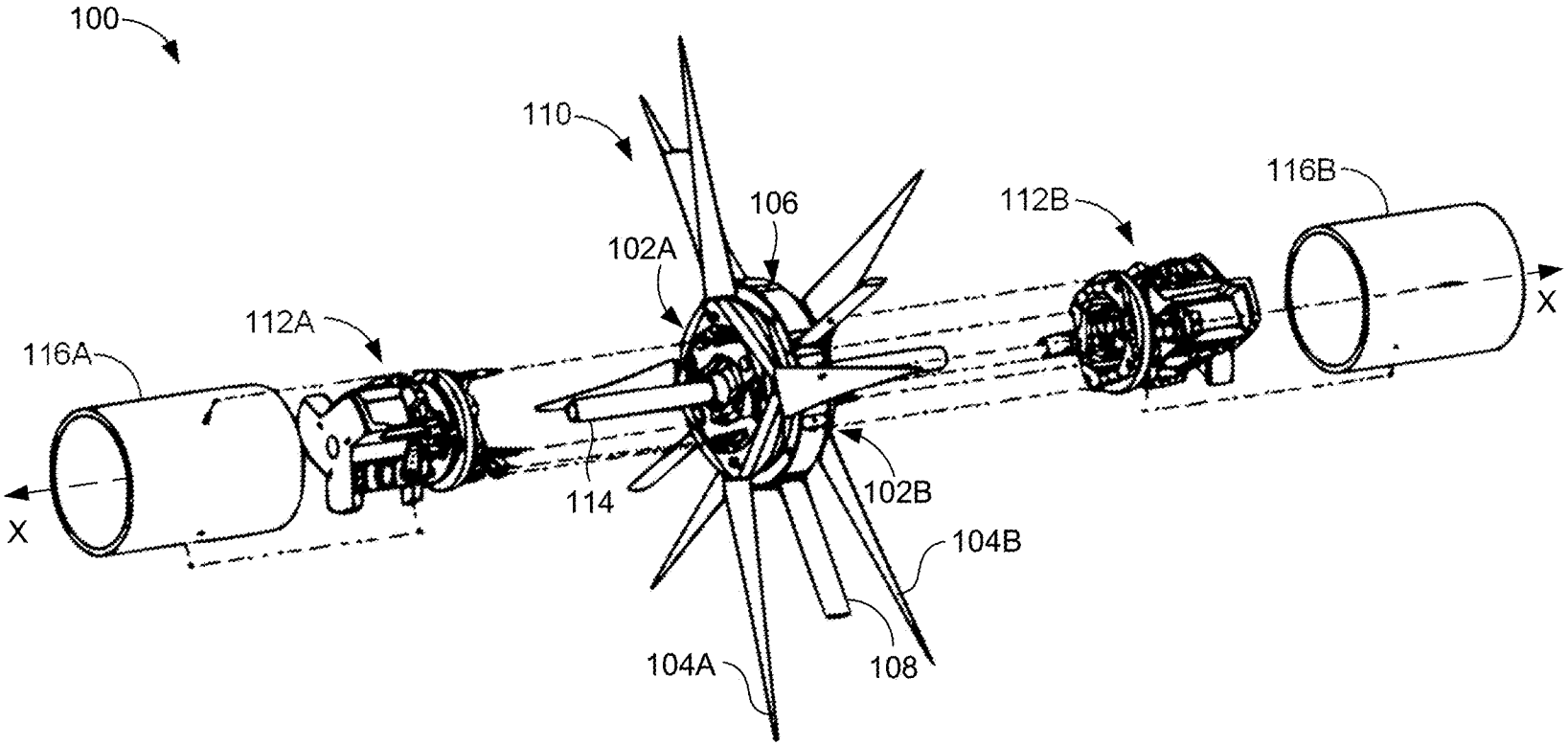
FIG. 2 illustrates an exploded view of the example high-speed omnidirectional underwater propulsion mechanism shown in FIG. 1 according to various embodiments described herein.

As shown in FIG. 2, the high-speed omnidirectional underwater propulsion mechanism 100 can include a central drivetrain mechanism 110 and two servo-swashplate actuation mechanisms 112A and 112B (collectively "swashplate actuation mechanisms 112") positioned along the main axis (X) on opposing sides of the central drivetrain mechanism 110. The servo-swashplate actuation mechanisms 112A and 112B are mechanically coupled to the pivotable blades 104A and 104B, respectively, on a respective rotor 102A and 102B to control the pitch of the pivotable blades 104A and 104B. As shown, the high-speed omnidirectional underwater propulsion mechanism 100 can also include a hollow stationary structural tubing framework 114 centered about the main axis (X) and outer hull sections 116A and 116B enclosing the servo-swashplate actuation mechanisms 112A and 112B at each end of the high-speed omnidirectional underwater propulsion mechanism 100.

In the example shown, the high-speed omnidirectional underwater propulsion mechanism 100 utilizes two decoupled counter-rotating rotors 102A and 102B. The rotors 102A and 102B include a number of highly actuated blades 104A and 104B, respectively, centered around the hollow stationary structural tubing framework 114. The central stationary structural tubing 114 can allow for the safe wiring of brushless motors 118 (FIG. 3) operating at maximum load. For example, four 670-watt brushless motors can be used in one case, although any suitable motors can be relied upon. The hulls 116A and 116B are intended to be largely free flowing for required motor cooling and quick deployment. Such cooling is made necessary by the considerable power-to-volume ratio of the motors, enabling the UUV 10 to produce significant forces, such as 2500 N or more, on its primary axis. In an example, the outer hulls 116A and 116B can have a main diameter of 0.14 m and length of 0.41 m without the nose attachments 12.

Figure 3:
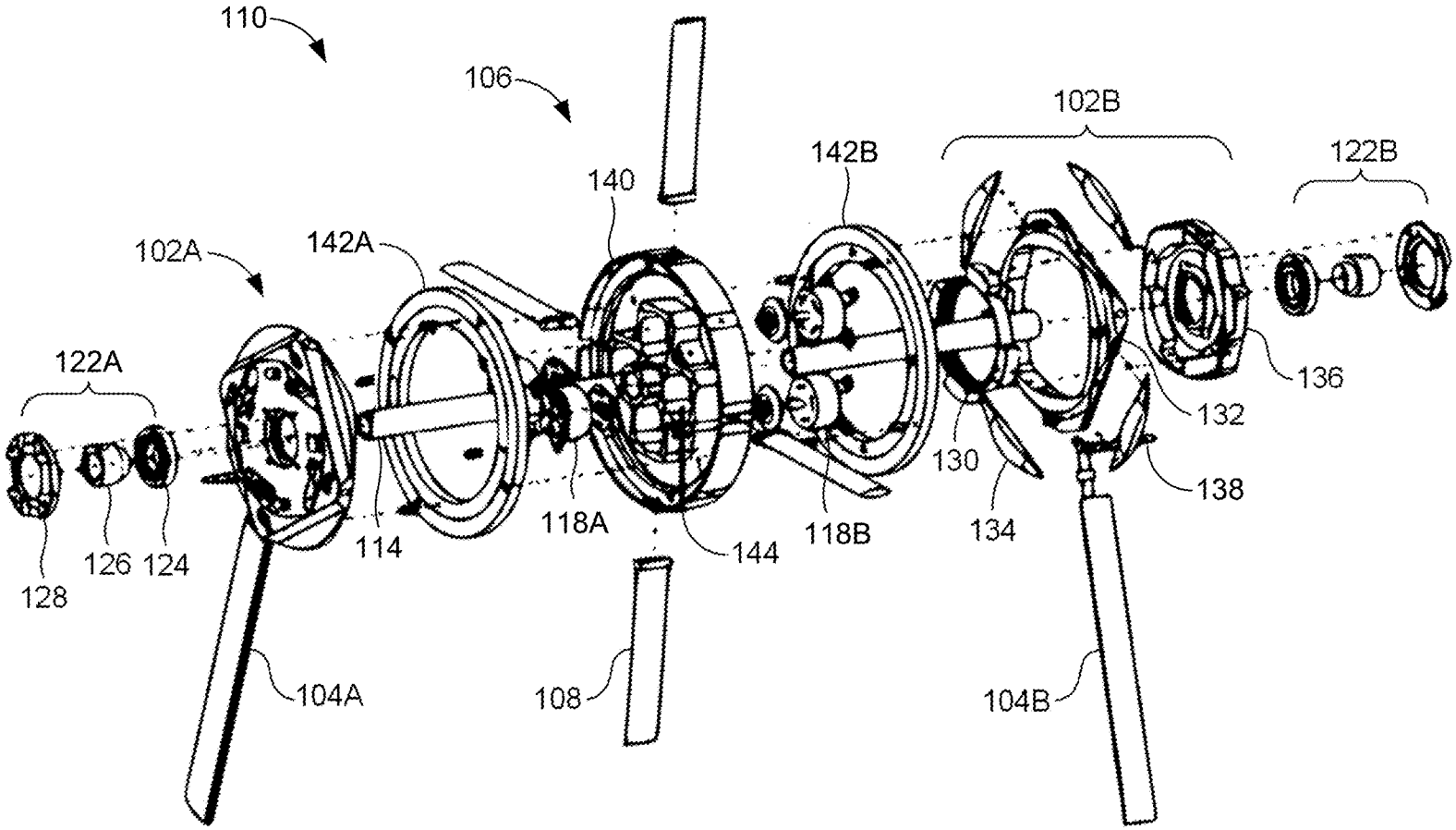
FIG. 3 illustrates an exploded view of an example drive-train for the high-speed omnidirectional underwater propulsion mechanism shown in FIG. 2 according to various embodiments described herein.

Shown in FIG. 3, an exploded view of the example drivetrain 110 for the high-speed omnidirectional underwater propulsion mechanism 100 of FIG. 2 is shown in greater detail. The central drivetrain mechanism 110 can include two dynamic blade assemblies. The dynamic blade assemblies include the counter-rotating rotors 102A and 102B centered on the main axis (X). Each rotor 102A and 102B is secured on each side of the drivetrain 110 with a respective locking means 122A and 112B. For example, the locking means 122A includes a corrosion-resistant bearing 124, bearing back bone adapter 126, and a control adapter-bearing lock 128.

Each dynamic blade assembly can comprise a rotor 102A or 102B, and each includes a plurality of pivotable blades 104A or 104B, although only one pivotable blade is shown for each rotor 102A or 102B in FIG. 3. As shown in the example of FIG. 3, the rotor 102A can include a direct transmission gear 130, a blade to transmission coupler and shock buffer 132, a plurality of shock buffer flow correctors 134 positioned about the blade to transmission coupler and shock buffer 132, and a gear/bearing/pitch control adapter 136. A plurality of pivotable blades 104A can be attached about the circumference of the rotor 102A at equidistant intervals. Although the examples shown in FIGS. 1 and 2 illustrate rotors having four pivotable blades attached, the high-speed omnidirectional underwater propulsion mechanism 100 can be configured with at least three blades, including four, five, six, seven, eight or more blades on each rotor 102A and 102B. Each pivotable blade, such as the pivotable blade 104A, includes a dynamic blade pivot adapter 138 connected at its proximal end.

A blade-axis re-enforcing flap adapter (BARFA) 106 can be positioned in a region between the two decoupled counter-rotating rotors 102A and 102B centered on the main axis (X). The BARFA 106 can be configured in a locked alignment between the rotors 102A and 102B to reduce unwanted physical blade interactions and control undesired flow leakage created by the counter rotating blades 104A and 104B. The BARFA 106 includes a plurality of stationary flaps 108. The stationary flaps 108 can be stationary blades or fixed blades attached to or formed with the central stationary section. Although the BARFA 106 is shown with four flaps 108, additional stationary flaps 108 may be needed to eliminate the undesired tangential flows, while maintaining the desired radial and axial flow components between counter rotating blades of the rotors 102A and 102B. For example, the control parameters disclosed herein are based on a high-speed omnidirectional underwater propulsion mechanism 100 with a BARFA 106 having at least eight stationary flaps 108. As shown FIG. 3, the BARFA 106 can include a central stationary section 140 from which a plurality of stationary flaps 108 can attach and two lazy susan bearings 142A and 142B positioned on opposite sides of the central stationary section 140. Each lazy susan bearing 142A and 142B attaches directly to the blade to transmission coupler and shock buffer 132 for each rotor. In some examples, the lazy susan bearing 142 and the blade to transmission coupler and shock buffer 132 are connected through perpendicular standoffs to geometrically lock the rotors 102A and 102B about the main axis (X).

The drivetrain is powered by two pairs of motors 118A and 118B (collectively "motors 118"). Each of the rotors 102A and 102B is driven by one of the pairs of motors 118A and 118B, respectively, mounted in a motor holder 144 within the BARFA 106 and facing opposite directions. The motors 118A and 118B are configured to rotate the rotors 102A and 102B, respectively, turning in opposing directions, as shown in greater detail in FIGS. 4A and 4B.

Figure 4B:
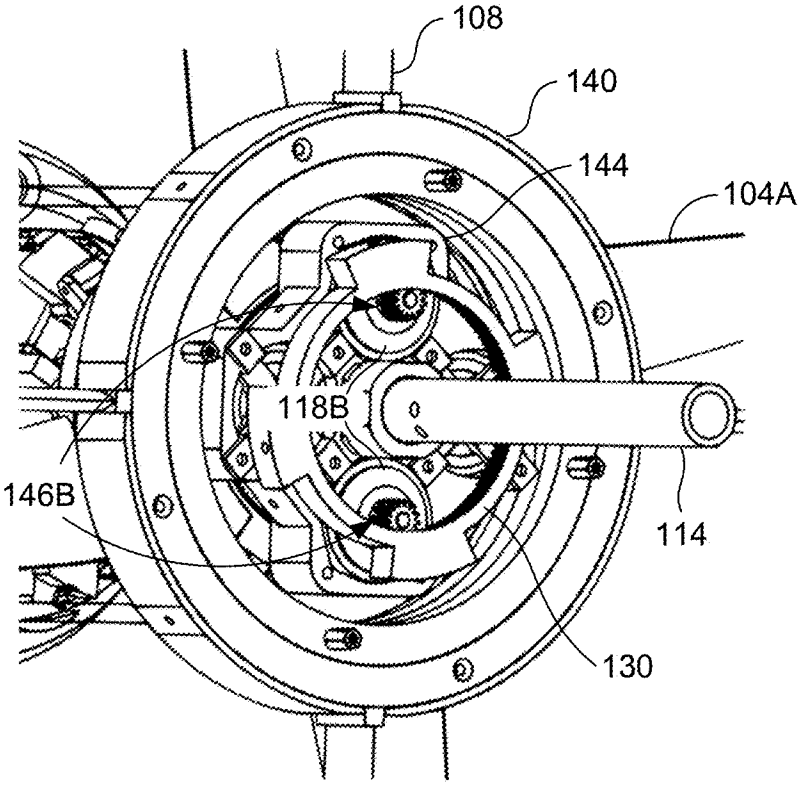
FIGS. 4A and 4B illustrate an example anti-slip solution via force-balancing of a twin-motor gear setup for the high-speed omnidirectional underwater propulsion mechanism shown in FIG. 2 according to various embodiments described herein.
Figure 4A:
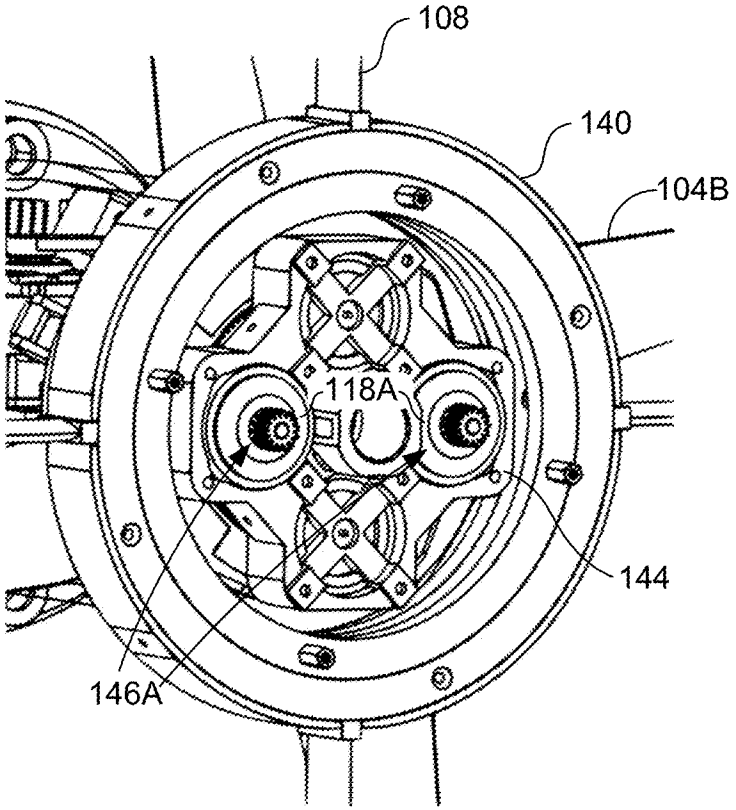

FIGS. 4A and 4B illustrate an example anti-slip solution via force-balancing of a twin-motor gear setup for the high-speed omnidirectional underwater propulsion mechanism 100 shown in FIG. 2. FIG. 4A is a view from one side of the central drivetrain mechanism 110, and FIG. 4B is a view from the opposite side of the central drivetrain mechanism 110. In FIG. 4A, the pair of motors 118A is shown with motor gear attachments 146A on each motor in the pair of motors 118A. In FIG. 4B, the opposite side of the motor holder 144 is shown with the pair of motors 118B on the top and bottom, each with motor gear attachments 146B. This view is also illustrated with the addition of the direct transmission gear 130 of a blade assembly. The pair of motors 118B with motor gear attachments 146B in this configuration reduces gear slipping. For example, as each motor of the pair of motors 118A rotates in a counterclockwise direction, the direct transmission gear 130, and thus the blade assembly including the rotor 102A, is also driven in the same counterclockwise direction with respect to that face of the BARFA 106. Similarly, on the opposite side of the BARFA 106, facing the motor holder 144, the motors 118B and respective blade assembly including rotor 102B is also driven in a counterclockwise direction with respect to that opposing face of the BARFA 106. The paired motors 118A and 118B housed in opposite facing directions share a midpoint to balance the forces, but operate independently.

For example, the two rotors 102A and 102B are decoupled and can rotate at different speeds. While the rotors 102A and 102B are driven by the two pairs of motors 118A and 118B, the direction of movement is controlled by actuating the blades 104A and 104B on the rotors 102A and 102B via the servo-swashplate actuation mechanisms 112A and 112B (FIGS. 2 and 5), respectively, corresponding to each rotor 102A and 102B.

Figure 5:
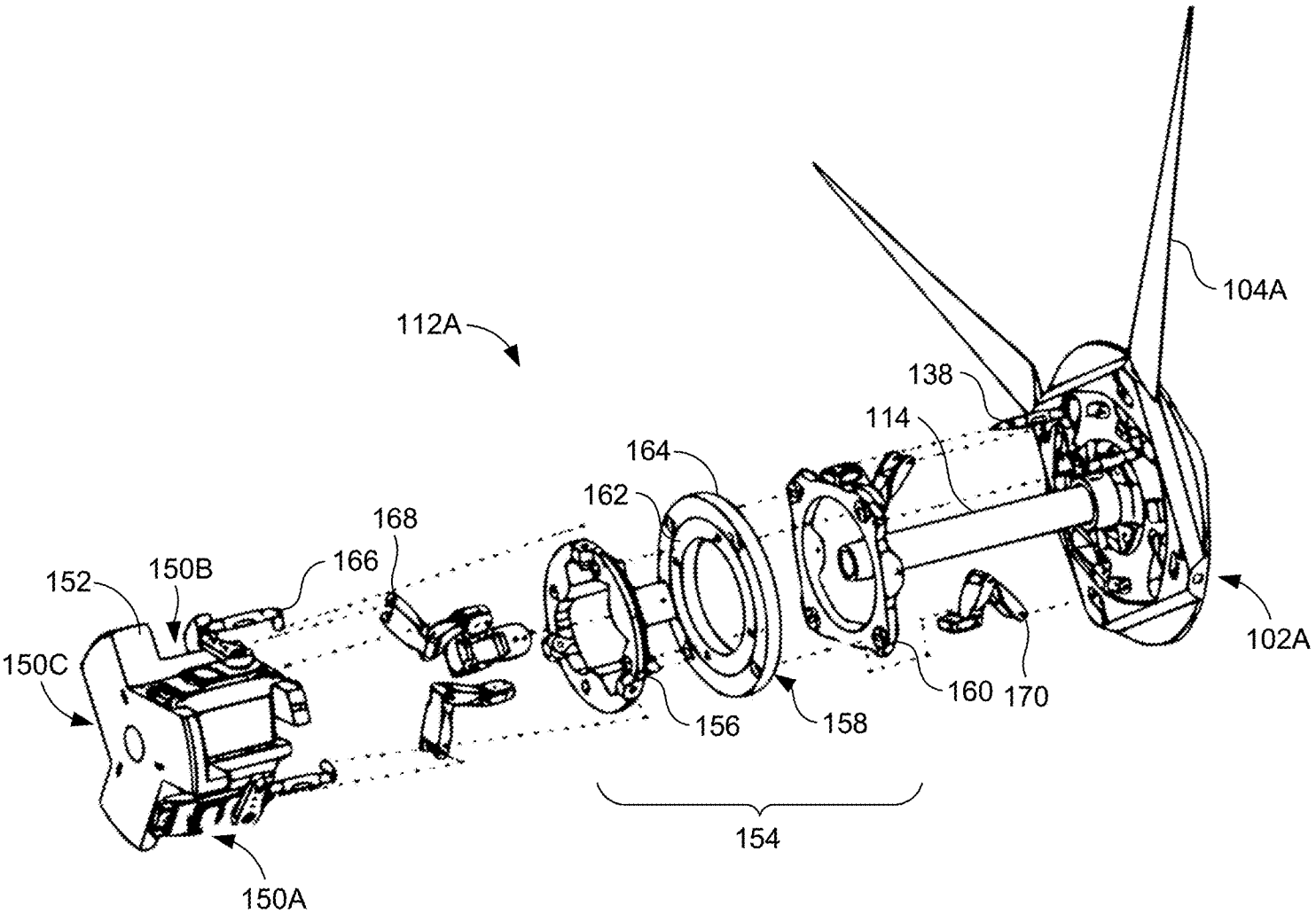
FIG. 5 illustrates an exploded view of an example servo-swashplate actuator mechanism for the high-speed omnidirectional underwater propulsion mechanism shown in FIG. 2 according to various embodiments described herein.

The two servo-swashplate actuation mechanisms 112A and 112B can be positioned along the main axis (X) on opposing sides (FIG. 2) of the drivetrain 110, with each servo-swashplate actuation mechanism 112A and 112B connected to a respective rotor 102A and 102B. FIG. 5 illustrates an exploded view of the example servo-swashplate actuation mechanism 112A, shown with respect to a blade assembly. The servo-swashplate actuation mechanism 112A includes three servos 150A, 150B, and 150C (collectively "servos 150") secured in a servo housing 152 and a wide bearing assembly that forms a swashplate 154 configured to be connected to the rotor 102A. The wide bearing assembly or swashplate 154 can include an inner susan bearing to swashplate adapter 156, a lazy susan bearing 158, and an outer susan bearing to swashplate adapter 160. The inner susan bearing to swashplate adapter 156 includes an inner ring portion 162 connected to the servos and an outer ring portion 164 connected to the respective rotor 102.

The servo-swashplate actuation mechanism 112A can be configured to actuate the pivotable blades 104A of the rotor 102A via a plurality of dynamic blade pivot adapters 138. Each of the two rotors 102 is connected to a servo-swashplate actuation mechanism (SSPAM) 112, which quickly manipulates the pitch of spinning blades in a passive controlled manner, independent of the rotation rate. In the example shown in FIG. 5, this manipulation is realized by using the three servos 150 to alter the planar projection of the swashplate 154 connected to the trailing edge of each pivotable blade 104A. All blades 104A must remain phase-locked with the swashplate 154 to allow the swashplate 154 to both pull and push on blade pivots. To ensure blade-swashplate phase-alignment, blade pivot arms 138 are arranged as four-bar linkages to lock their alignment with the main axis.

As shown in FIG. 5, each of the servos 150 has a servo-swashplate linkage 166 which is attach to an inner susan bearing to swashplate adapter 156. Each servo 150 in the servo housing 152 is connected to the swashplate 154 via a non-rotary swashplate hinge 168 seated within an interior portion of the inner susan bearing to swashplate adapter 156. This assembled non-rotary portion of the servo-swashplate actuation mechanism 112A is coupled via the inner susan bearing to swashplate adapter 156 with the inner portion 162 of lazy susan bearing 158. The outer portion 164 of the lazy susan bearing 158 can be coupled with the outer susan bearing to swashplate adapter 160 to attach to the rotor 102 and rotates with the rotor. The outer susan bearing to swashplate adapter 160 having a pair of rotary swashplate hinges 170 connecting the outer susan bearing to swashplate adapter 160 to the rotor 102A. The plurality of dynamic blade pivot adapters 138 extend from the outer susan bearing to swashplate adapter 160 to each of the blades 104 of the rotor 102. Each dynamic blade pivot adapter 138 configured to control the pitch of the respective blade 104 to which it is attached.

Figure 6:
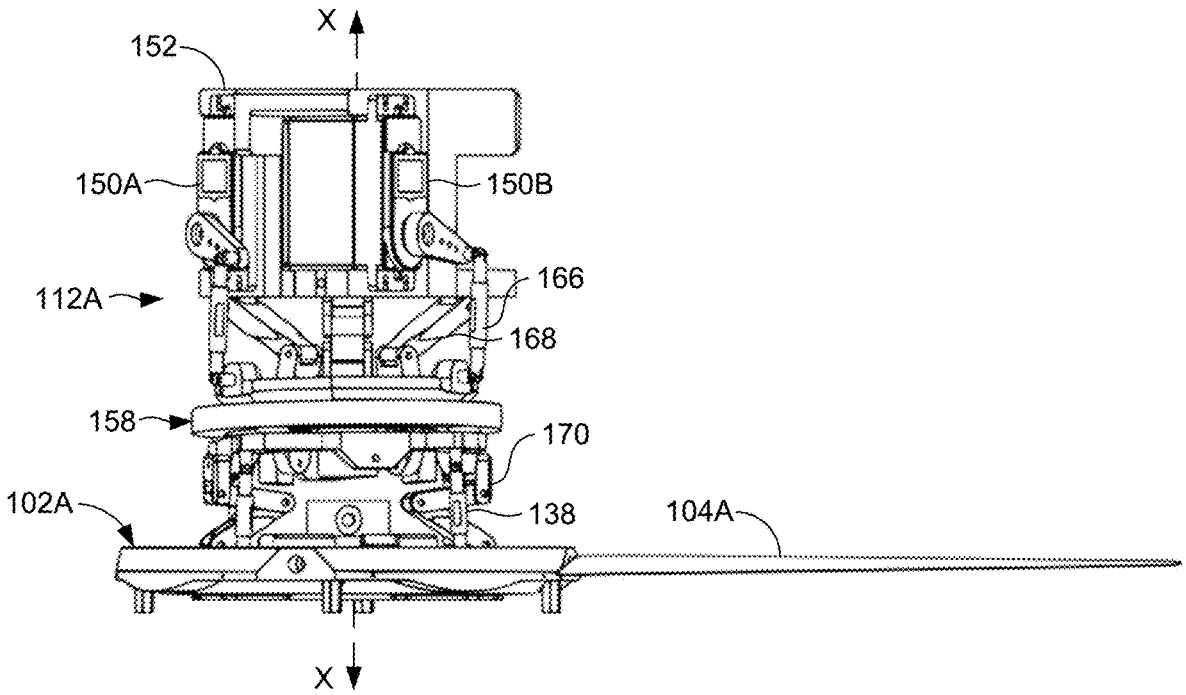
FIG. 6 illustrates an example of an assembled servo-swashplate actuator mechanism shown in FIG. 5 connected to a rotor according to various embodiments described herein.

Shown in FIG. 6 is a portion of the high-speed omnidirectional underwater propulsion mechanism 100 with the servo-swashplate actuation mechanism 112A connected to the rotor 102A. The servos 150 can be controlled to actuate the swashplate 158 to control the pitch of individual blades 104A of the rotor 102A to which the servo-swashplate actuation mechanism 112A is attached. In this configuration, the servos 150 in the housing 152 are fixed in position with respect to the main axis (X) and the rotor 102A is allowed to rotate about the same main axis (X). The swashplate 158 is actuated by the servos 150 to adjust the plane of the swashplate 158, while maintaining the same centroid at the main axis (X). While the pitch of the blades 104A are adjusted dynamically based on the position of the swashplate 158, the rotor 102A maintains the same plane of rotation.

With respect to the coordinate system of the UUV 10 shown in FIG. 1, a controller can be configured to control the individual servos 150 to control movement of the high-speed omnidirectional underwater propulsion mechanism 100 and UUV 10 in six degrees of freedom. The control-commands implemented by the controller and physically executed by the physical three-servo configuration can change the plane of the swashplate to control three translational movements and three rotational movements: heave (move up and down), sway (move left and right), surge (move forward and backward), yaw (rotate left and right), pitch (tilts forward and backward), and rolling (pivots side to side). As will be described in further detail, $\alpha$ is defined as the global surge control parameter, $\beta$ is defined as the global yaw control parameter, $\Gamma$ is defined as the global sway parameter, and $\delta$ is defined as the global roll control parameter.

Figure 7:
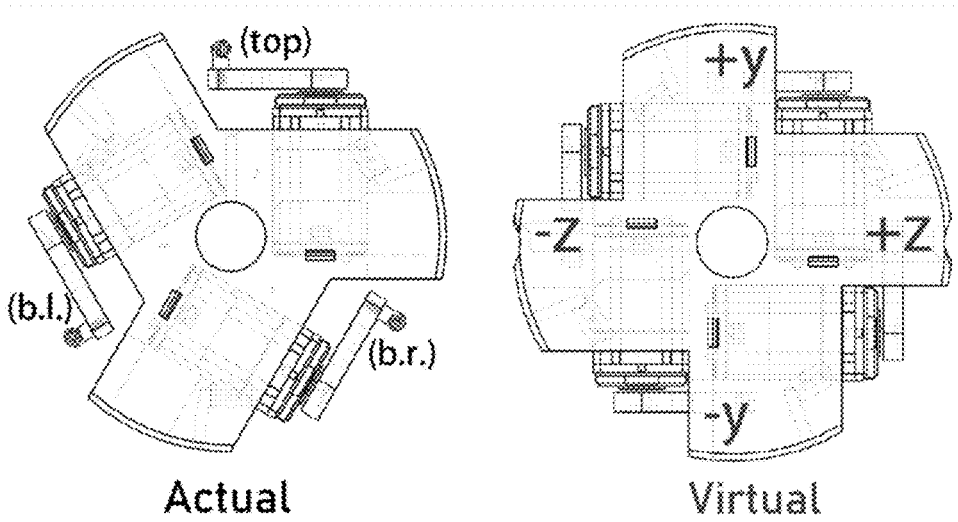
FIG. 7 illustrates a three-servo configuration mapped to a virtual four-servo configuration for the example servo-swashplate actuator shown in FIG. 5 according to various embodiments described herein.

As shown in the example in FIG. 1, the counter rotating rotors 102 operate substantially in the yz plane. With the servos 150 in the housing 152 and rotor 102 positioned about the main axis (X), the control-commands can be demonstrated by mapping the three-servo configuration to a virtual four-servo configuration to show the orientation in the yz-plane, as shown in FIG. 7.

For example, a virtual four-servo-per-rotor model can greatly facilitate control-command implementation by considering a configuration with four servos: +y, −y, +z, and −z. Each servo 150 directly controls the pitch of blades 104 passing through its particular quadrant, and all four virtual servos are given the same forward offset parameter. A top servo (+y) controls the pitch of all blades passing through its (top) quadrant. A bottom servo (−y) controls the pitch of all blades passing through the bottom quadrant, while the difference between the two controls the relative thrust effort between top and bottom quadrants, thus controlling the yaw-related moment across the hull itself. The shared forward offset between these servos +y and −y directly controls the net forward thrust of all blades passing through quadrants +y and −y. For example, when the same forward offset is applied to four blades, it is an adequate control for overall surge thrust, as thrust is linear with blade pitch in our angle range and can therefore be superimposed. Physical servo-arm and blade-pivot geometries are chosen for blade angles to match corresponding actuator angles in a four-servo configuration. The four-servo plate-control model is realized in the three-servo physical configuration with a simple transformation, where the three servos are labeled (top), (b.r.), and (b.l.).

$$L(\text{top}) = L(+y) \tag{1}$$

$$L(b.r.) = \frac{1-\sqrt{3}}{4}L(+y) + \frac{3-\sqrt{3}}{4}L(-y) + \frac{\sqrt{3}}{2}L(+z),$$

-continued $$L(b.l.) = \frac{1-\sqrt{3}}{4}L(+y) + \frac{3-\sqrt{3}}{4}L(-y) + \frac{\sqrt{3}}{2}L(-z)$$

where (top) represents the uppermost servo, (b.r.) represents the bottom right servo, and (b.l.) represents the bottom left servo in a triangular orientation. A four-servo controller would use this transformation to output appropriate values to servos in the physical three-servo model.

The four-servo-per-rotor virtual configuration also allows for decoupled bi-planar control and intuitive two-dimensional Cartesian controller representation. Because all four servos are fed with the same forward offset surge-command, servos ±z can control the behavior of the UUV 10, for example, in the horizontal plane, while servos ±y control the behavior in the vertical plane (FIG. 1). Furthermore, any subsequent horizontal-plane control parameter that is fed to servo +z as a value N will be fed to servo −z as the value −N. The same holds true for servos ±y. With the centroid of the swash plate connecting the four servos never shifts for such control inputs, completely decoupling inputs unique to the xy plane from inputs unique to the xz plane. A two-dimensional representation can then be constructed that depicts how the UUV 10, for example, behaves in the isolated xy plane. Viewing the entire hull from the side, interactions between virtual actuators ±y on the ±x rotors during different maneuvers can be explored.

For example, for a two-dimensional surge maneuver on a full ROV implementation, the surge parameter α can be fed to all servos, causing a positive thrust in x̂. Likewise, for a yaw maneuver in two dimensions, control inputs governed by global vertical yaw parameter β can be specified. For example, yaw inputs −β, β, −β, and β can be fed directly to servos 1, 2, 3, and 4, respectively. Additionally, control parameters can be superimposed to achieve multiple maneuvers simultaneously, since interfere can be avoided due to the rigid nature of the blades. For example, control parameters α and β can be fed to servos 1-4 to execute two independent control modes at once.

A third control parameter Γ is proposed for sway. Such a maneuver is made possible from the rigid nature of the blades and durable alignment-locking of the rotor axes. As with the other planar control parameters, sway-related actuator inputs do not shift swashplate centroids, maintaining isolation between all vertical and horizontal-plane maneuvers. The lack of kinematic overlap allows for superposition of all control parameters, as they do not fundamentally interfere with each other.

To prevent unwanted physical blade interactions, rotors are locked in alignment about their respective axes through the BARFA 106. The BARFA 106 allows the rotors 102 to push against one-another without touching and contains the stationary flaps 108 responsible for reducing unwanted flow during the sway maneuver. The space between the rotors 102 can result in a pressure differential in the space between the rotors 102. Flow leakage between the high and low pressure regions can reduce sway thrust. The undesired flow leakage can be identified as any tangential flow component of the fluid between the rotor blades 104, for example. The BARFA 106 minimizes the unwanted flows using the stationary flaps 108. Although the BARFA 106 is shown in FIG. 3 with only four stationary flaps 108, at least eight stationary flaps 108 are preferred to help eliminate the undesired tangential flows, while maintaining the desired radial and axial flow components between the blades 104. The BARFA can have eight stationary flaps or more than eight stationary flaps. The at least eight stationary flaps of the BARFA reduce flow leakage between high and low pressure regions in the region between the two decoupled counter-rotating rotors. The stationary flaps of the BARFA reduce unwanted flow during a sway maneuver of the propulsion system.

Final inputs to virtual servos 1-4 are then respectively α−β−Γ, α+β+Γ, α−β+Γ, and α+β−Γ. The control parameter can be set to the physical control limit of each servo, for example: α∈(−10°, 10°), β∈(−10°, 10°), and Γ∈(−10°, 10°) such that |α+β+Γ|<30°. Servo arm and blade pivot lengths can be chosen to match blade angles with servo angles in corresponding quadrants.

The rotors 102 are decoupled from one-another to allow for simple roll control via torque-balancing. Because the effective input to each rotor 102 is torque, not speed, roll-torque remains balanced regardless of blade parameters and relative speed, as rotation rate is simply a byproduct of the torque input. This allows for roll control via a single parameter δ, effectively decoupled from all other parameters and realized merely by varying the relative effort between the two rotors. The separate rotors are read 90% effort ±δ, where δ∈(−10%, 10%). Control parameters are then mapped to physical actuator commands as follows:

$$\begin{bmatrix} +x \text{ Rotor Effort} \\ -x \text{ Rotor Effort} \\ +x \text{ "top" Servo Angle} \\ +x \text{ "b.r." Servo Angle} \\ +x \text{ "b.l." Servo Angle} \\ -x \text{ "top" Servo Angle} \\ -x \text{ "b.r." Servo Angle} \\ -x \text{ "b.l." Servo Angle} \end{bmatrix} = \begin{bmatrix} 90\% \\ 90\% \\ 90^\circ \\ 90^\circ \\ 90^\circ \\ 90^\circ \\ 90^\circ \\ 90^\circ \end{bmatrix} + \begin{bmatrix} 0 & 0 & 0 & -1 & 0 & 0 \\ 0 & 0 & 0 & 1 & 0 & 0 \\ 1 & 0 & -1 & 0 & -1 & 0 \\ 1 & \frac{\sqrt{3}}{2} & \frac{1}{2} & 0 & \frac{1}{2} & -\frac{\sqrt{3}}{2} \\ 1 & -\frac{\sqrt{3}}{2} & \frac{1}{2} & 0 & \frac{1}{2} & \frac{\sqrt{3}}{2} \\ -1 & 0 & -1 & 0 & 1 & 0 \\ -1 & -\frac{\sqrt{3}}{2} & \frac{1}{2} & 0 & \frac{-1}{2} & -\frac{\sqrt{3}}{2} \\ -1 & \frac{\sqrt{3}}{2} & \frac{1}{2} & 0 & \frac{-1}{1} & \frac{\sqrt{3}}{2} \end{bmatrix}, \quad (2)$$

where $\Gamma_y$ and $\Gamma_z$ respectively control force along ŷ and ẑ while $\beta_y$ and $\Gamma_z$ respectively control moment about ŷ and ẑ.

Figure 8:
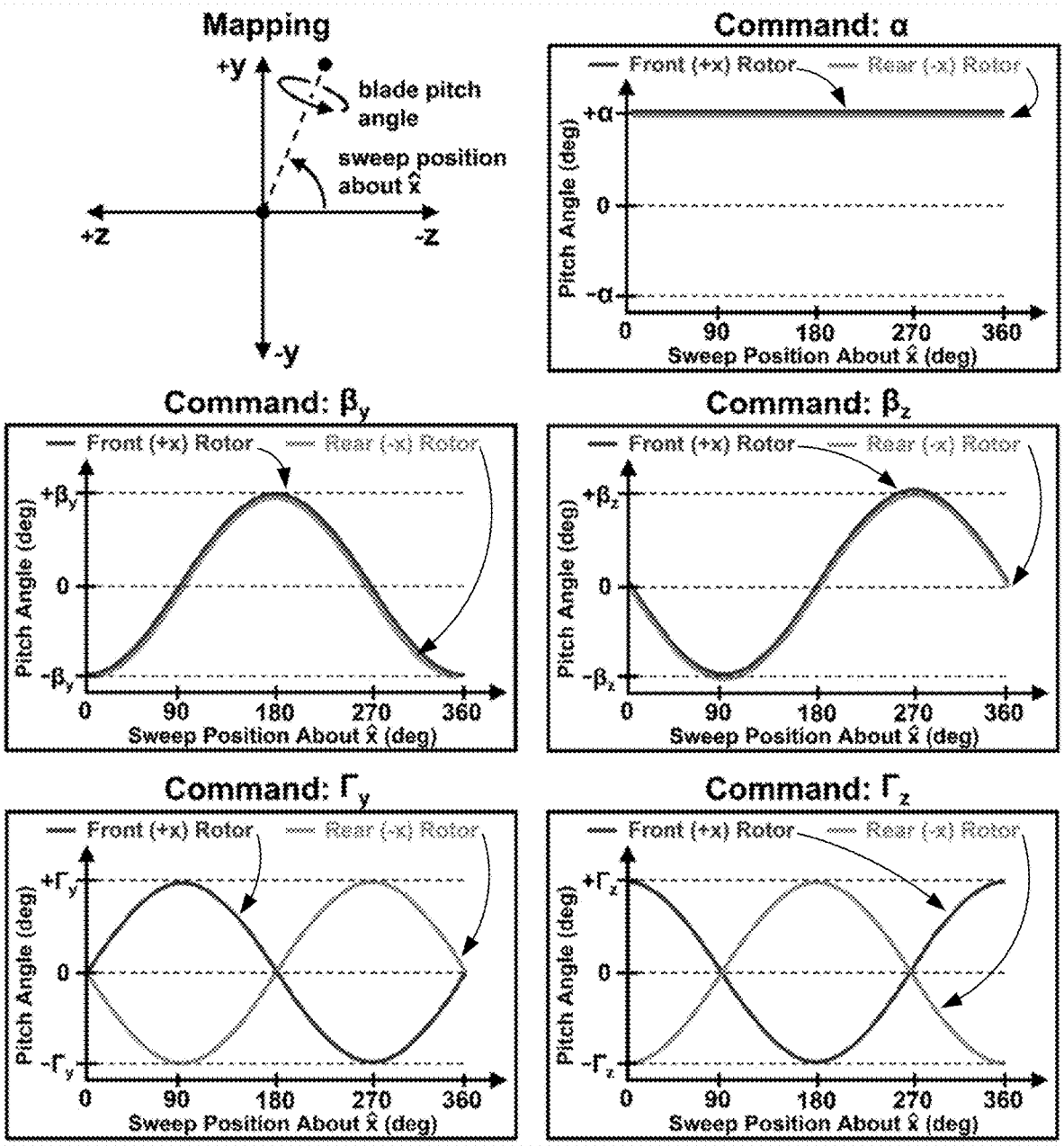
FIG. 8 illustrates blade pitch angles throughout sweep for control commands according to various embodiments described herein.

FIG. 8 illustrates how the blades 104 alter pitch during their sweep about x̂, in response to each superimposable control parameter α, $\beta_y$, $\beta_z$, $\Gamma_y$, and $\Gamma_z$. For α, the blades 104A of the front (+x) rotor 102A and the blades 104B of the rear (−x) rotor 102B operate with the same pitch angles. For $\beta_y$ and $\beta_z$, as the sweep position varies, the pitch angle of the blades 104A and 104B varies in the same manner for the front (+x) rotor 102A and the rear (−x) rotor 104B. For $\Gamma_y$, and $\Gamma_z$, the pitch angle for the blades 104B of the rear (−x) rotor 102B is negative of the pitch angle for the blades 102A of the front (+x) rotor 102A.

For example, in no reasonable scenario will pulling all blade pitches forward not cause the UUV 10 to surge as intended if properly programmed with servo limits considered. Yaw and roll control parameters are similarly straightforward. The omnidirectionality of the high-speed omnidirectional underwater propulsion mechanism 100 comes from its unique ability to potentially sway quickly, allowing it to move in any orientation at speeds far beyond the scope of ROVs or AUVs. STARCCM+ computational fluid dynamic (CFD) simulations suggest the propulsor can generate sway thrust at a magnitude near 10-20% surge thrust capability.

Figure 9:
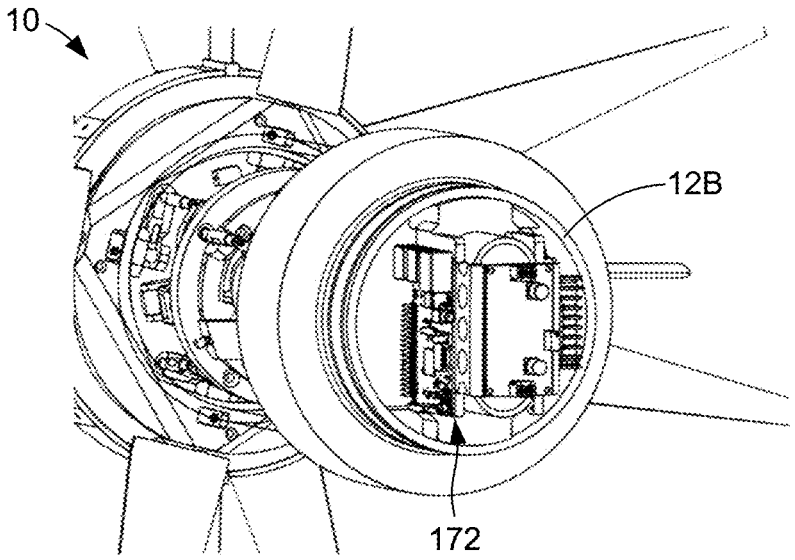
FIG. 9 illustrates an example of a controller positioned within a nose attachment of the unmanned underwater vehicle shown in FIG. 1 according to various embodiments described herein.

FIG. 9 illustrates an example of a controller 172 positioned within the nose attachment 12B of the UUV 10 shown in FIG. 1. The control parameters discussed above can be calculated and implemented by the controller 172. The controller 172 can be connected to each of the servos 150 and each of the rotors 102 via the stationary structural tubing framework 114 to implement the control command.

The controller 172 can be embodied in the form of hardware, firmware, software executable by hardware, or as any combination thereof. The controller 172 can also include memory for storing instructions, including software-based computer-readable instructions. If embodied as hardware, the controller 172 can be implemented as a collection of discrete analog, digital, or mixed analog and digital circuit components. The hardware can include one or more discrete logic circuits, microprocessors, microcontrollers, or digital signal processors (DSPs), application specific integrated circuits (ASICs), programmable logic devices (e.g., field-programmable gate array (FPGAs)), or complex programmable logic devices (CPLDs)), among other types of processing circuitry.

The controller 172 can also be embodied as one or more microprocessors, microcontrollers, or DSPs, for example. The controller 172 can execute software or computer readable instructions, stored on a memory device, to perform the control aspects of the embodiments described herein. Any software or program instructions can be embodied in or on any suitable type of non-transitory computer-readable medium for execution. Example computer-readable mediums include any suitable physical (i.e., non-transitory or non-signal) volatile and non-volatile, random and sequential access, read/write and read-only, media, such as a hard disk, magnetic device, semiconductor device (e.g., flash, magneto-resistive, etc.), and other memory devices.

In one example, the controller 172 can be embodied as a microcontroller, such as an Arduino® or Raspberry Pi® microcontroller. One or more power supply or power conversion units can also be positioned within the nose attachment 12B (and possibly within the nose attachment 12B), to independently provide power to the servos 150, the controller 172, and the electronic speed controller for the motors 118 of the rotors 102. In one example, three separate Buck converters can independently provide power to the servos 150 and a battery can provide power for the controller 172, although other power arrangements can be relied upon. In some examples, power can be supplied to the equipment in the nose attachment 12B via a tether power conversion unit 16.

Among other functions, the controller 172 can be configured to control the overall speed of the rotors 102 and calculate the plurality of control parameters described herein. The controller 172 can compensate a first control parameter among the control parameters. The controller 172 can also generate a control signal for each of the servos 150 based on the control parameters. In that context, the controller 172 can be configured to calculate the control mode commands $\alpha$, $\Gamma_y$, $\Gamma_z$, $\delta$, $\beta_y$, and $\beta_z$ to direct the operations of the servos 150. The plurality of control parameters can include the surge control parameter $\alpha$, the yaw control parameter $\beta$, the sway control parameter $\Gamma$, and a roll control parameter $\delta$. The controller 172 can be configured to compensate the first control parameter to reduce cross-coupling of an unwanted force generated by drag forces on the two decoupled counter-rotating rotors. The controller 172 can be configured to compensate the first control parameter to reduce cross-coupling of an unwanted force due to a second control parameter. The first control parameter can include the sway control parameter $\Gamma$. The second control parameter can include the surge control parameter $\alpha$. In an example, the controller 172 can be configured to compensate the sway control parameter $\Gamma$ to reduce cross-coupling of an unwanted force due to the surge control parameter $\alpha$. The controller 172 can be configured to compensate the first control parameter to reduce cross-coupling of an unwanted force based on a ratio of the unwanted force to a desired force. The controller 172 can be configured to compensate the first control parameter to reduce cross-coupling of an unwanted force based on a system of equations linking two planes controlled by the servos.

Figure 10:
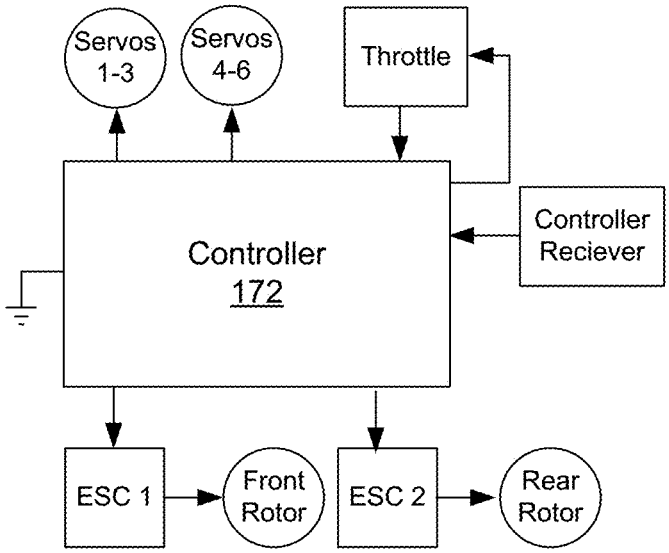
FIG. 10 illustrates an example configuration for a controller to implement control commands according to various embodiments described herein.

FIG. 10 illustrates an example configuration for the controller 172, to implement control commands according to various embodiments described herein. As shown in FIG. 10, the controller 172 can be connected to each of the servos 150, where servos 1-3 can correspond to the front rotor 102A and servos 4-6 can correspond to the rear rotor 102B. An external controller can be used to provide remote commands for control of the UUV 10 in some cases, and the remote commands can be received via a controller receiver. For example, the speed of the rotors 102A and 102B can be controlled separately via a throttle. The respective servo-swashplate actuation mechanisms 112 can also be adjusted to control the pitch of the blades 104 for each of the rotors 102. In an example, a throttle command can be read from an analog voltage divider that is powered by the controller 172. Control mode commands $\alpha$, $\Gamma_y$, $\Gamma_z$, $\delta$, $\beta_y$, $\beta_z$ can be interpreted from PWM inputs from an external controller.

A small-scale force-validation model was constructed to verify the conceptual working principles of the UUV 10. The model was tested in a water tank while fixed to an off-axis, 6-DOF force-sensing apparatus placed above the tank. The force-sensing apparatus is designed and fabricated economically using 80/20 aluminum bars to measure any forces and moments imposed by the attached propulsor at a depth of 0.3 m.

Because the small-scale force-validation model was never intended to physically accelerate, the overall design process was simplified, allowing the small-scale model to be economical and predominantly 3D-printed without mass-related limitations. For the small-scale force-validation model, the controller was implemented using an Arduino to implement control commands and read force sensors. The Arduino's single-threaded nature prohibits it from simultaneously executing these control mode commands while reading force sensors. Due to the required cool-down time between force-sensor readings, the Arduino's operating loop must update actuator commands every iteration, while only reading from force sensors every fourth iteration. The Arduino then reports the last known sensor readings on iterations between updates. This may have caused small illusory input-output delays between control mode commands and sensor readings. Illusory delays can be upwards of 0.2 seconds.

The experimental results are shown in FIGS. 11-17. At various motor efforts, different control commands were tested and compared against measured forces. Control commands were physically manifested as pitch changes onto the moving blades. Design geometries ensured that the magnitude of respective pitch change was directly proportional to the magnitude of control command change. For the Wortmann FX 76-100 hydrofoil blade profile used in the mechanism, lift forces generated were linear with blade angle of attack (AoA), hence with pitch and therefore control commands, until around 15° AoA. Even as the actuators rotate to achieve 15° pitch, the increasing fluid inflow velocity decreases the effective AoA on the blades. In turn, the linear pitch regime was actually expanded beyond 15° and was expected to encompass the full operating range of the servos. Control commands were then pushed well past their normal (−10°, 10°) restrictions during signal-maneuver tests, but were still be selectively limited to maintain force-command linearity.

Due to safety concerns, motor effort was not brought past 50% during the study. The brushless motors still operated under some hydrodynamic load, so direct motor effort commands to ESCs were expected to manifest more as torque than speed inputs. Because generated rotor forces are typically linear with torque, we expected forces generated from any particular command to also be linear with motor effort.

A. Pure Surge (α)

The surge-force $F_{surge}$ generated from the surge command α, for example, should then take the form $$F_{surge}=K_{\alpha}(\text{Motor Effort}-\text{Motor Offset})\cdot\alpha, \tag{3}$$

where $K_{\alpha}$ is a scaling factor that links command α to the output force $F_{surge}$ and encompasses all constant unknown hydrodynamic and motor-rate properties. Motor Effort describes the throttle command percent read to the ESCs and imposed on the rotors, while Motor Offset describes the smallest value at which the ESCs actually spin the motors. For the small-scale model, the Motor Offset value is expected to be around 13% effort.

At various motor efforts, different magnitudes of command α are tested and surge forces are recorded. These forces are normalized by corresponding α commands and plotted against motor effort. To validate the form of equation (3) and our operating principles as a whole, the plot should reveal a clear linear trend between normalized forces and motor efforts, with an x-axis crossing at around 13% motor effort. Normalized surge forces are plotted against motor effort in FIG. 11.

Figure 11:
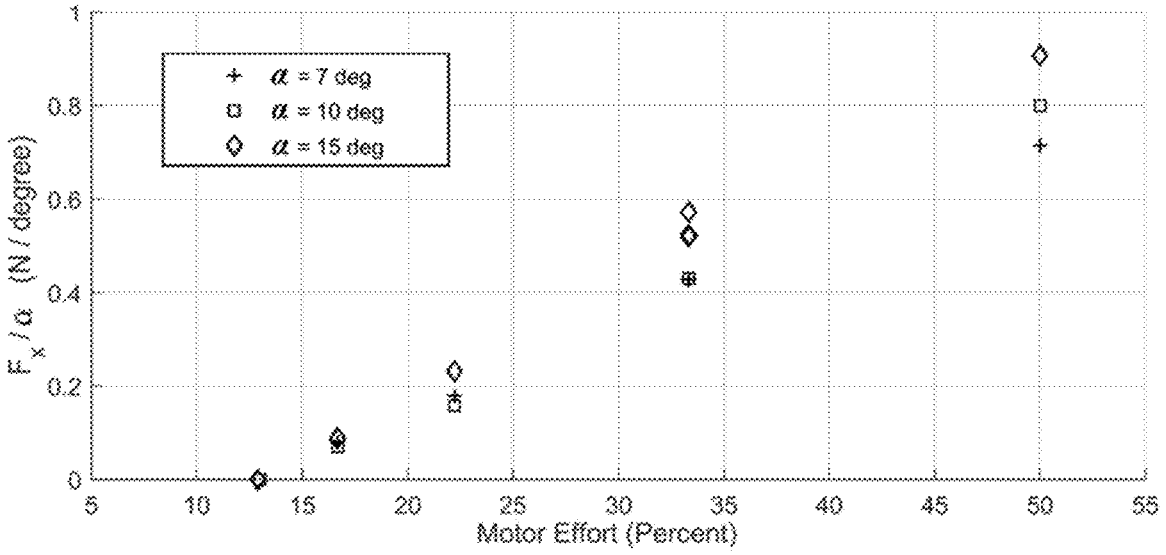
FIG. 11 illustrates example results of the surge forces normalized by $\alpha$ at various motor efforts according to various embodiments described herein.
Figure 12:
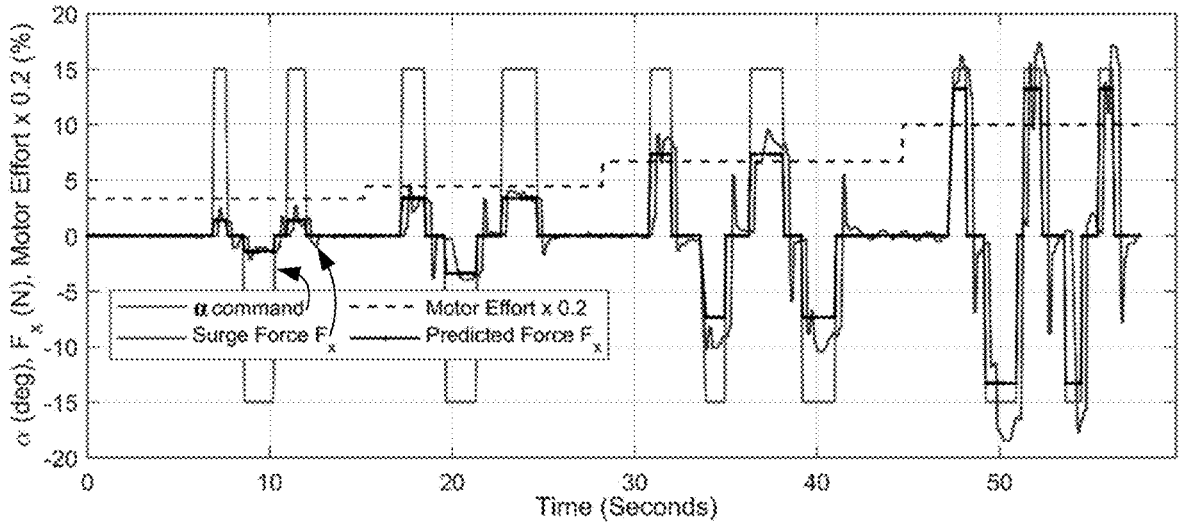
FIG. 12 illustrates example results of the pure-surge forces with $\alpha \pm 15°$ at various motor efforts according to various embodiments described herein.
Figure 13:
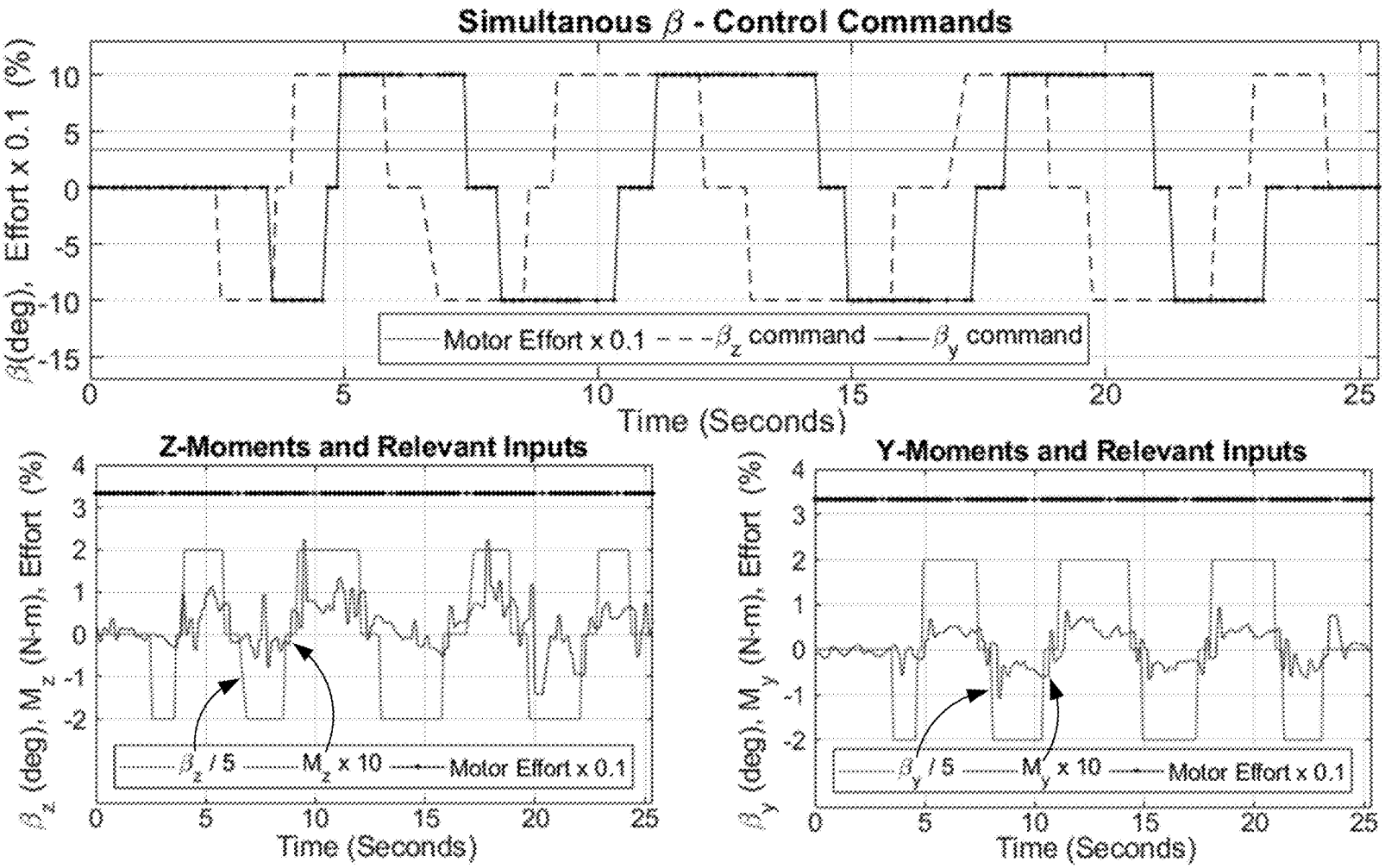
FIG. 13 illustrates example results of the simultaneous mixed-yaw forces with $\beta \pm 10°$ according to various embodiments described herein.

The equation (3) validated in FIG. 11, with $K_{\alpha}=2.37E^{-2}$. The small-scale propulsor was expected to generate around 32 N thrust at 100% motor effort for surge (α=15°). For completeness, results from a pure-surge test with 15° step commands at various motor efforts are presented in FIG. 12. FIG. 12 illustrates the pure-surge forces with α±15o at 16, 22, 33, and 50% motor effort.

It was found that perceived delays between input-commands and output-forces in FIG. 12 were illusory and caused primarily by force-sensor update lag. The attached propulsor must physically deflect a small amount before the sensors can generate readings, which can be exploited to analyze the propulsor's true reaction time using slow-motion capture. The start time was taken at the instant the servos start moving. Any hydrodynamic force delays were shown to be less than even the 20 ms rise-time of the pitch-actuating servos through slow-motion analysis. Deflection of the chassis is understood to coincide directly with actual sensor tension via Hooke's law.

B. Yaw (β)

Both kinematically and hydrodynamically, the yaw maneuver is understood to be very similar to the surge maneuver. While the surge maneuver generates surge force, the yaw maneuver similarly generates yaw moment. The lack of moment-arm due to the limited rotor span on the small-scale model greatly reduced the magnitude of moments measured. For the purposes of the study, the yaw maneuver need only be tested for existence and shown to be decoupled between the two different yaw-axes. Simultaneous $\beta_y$ and $\beta_z$ maneuvers are shown to be achievable and decoupled in FIG. 13. The test was conducted with 33% motor effort at β magnitudes of only ±10°.

C. Sway (Γ)

It is assumed that the force response to sway behaves in a similar manner to surge. Like surge, the sway-force $F_{sway}$ generated from sway command Γ should scale as $$F_{sway}=K_{\Gamma}(\text{Motor Effort}-\text{Motor Offset})\cdot\Gamma, \tag{4}$$

where $K_{\Gamma}$ is a scaling factor which links sway-command Γ to the output force $F_{sway}$ and encompasses all constant unknown hydrodynamic and motor-rate properties. For the small-scale model, the offset value is expected to be around 13% effort.

At various motor efforts, different magnitudes of command $\Gamma_y$ were tested and sway forces $F_y$ were recorded. These forces were normalized by their corresponding $\Gamma_y$ commands and plotted against motor effort. To validate the form of question (4) and the operating principles as a whole, the plot should reveal a clear linear trend between normalized forces and motor efforts, with an x-axis crossing at around 13% motor effort. Normalized sway forces are plotted against motor effort in FIG. 14.

Figure 14:
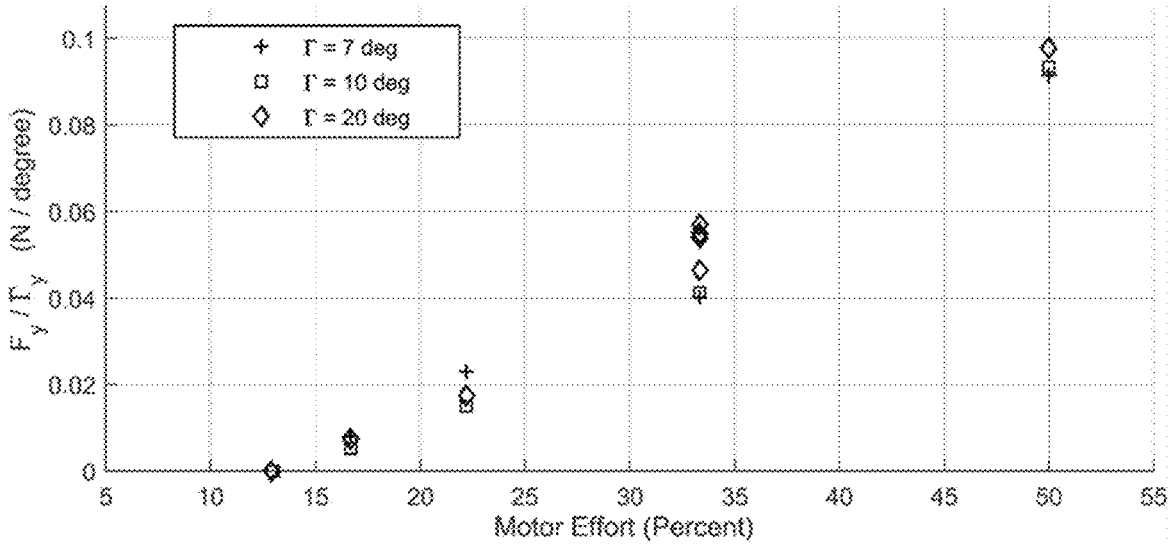
FIG. 14 illustrates example results of the sway forces normalized by $\Gamma$ at various motor efforts according to various embodiments described herein.
Figure 15:
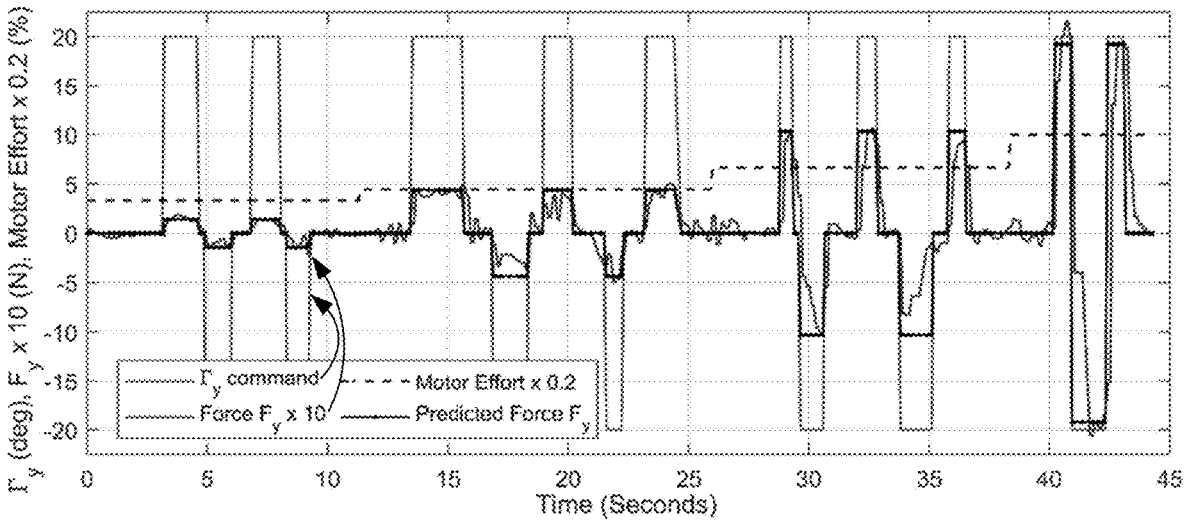
FIG. 15 illustrates example results of the pure-sway forces with $\Gamma_y \pm 20°$ at various motor efforts according to various embodiments described herein.

The equation (4) validated in FIG. 14, with $K_{\Gamma}=2.67E^{-3}$. The model predicts the small-scale propulsor to generate around 4.6 N at 100% motor effort for sway (Γ=20°). For completeness, results from a pure-sway test with 20° step commands at various motor efforts are presented in FIG. 15, showing pure-sway forces with $\Gamma_y$±20° at 16, 22, 33, and 50% motor effort.

Figure 16:
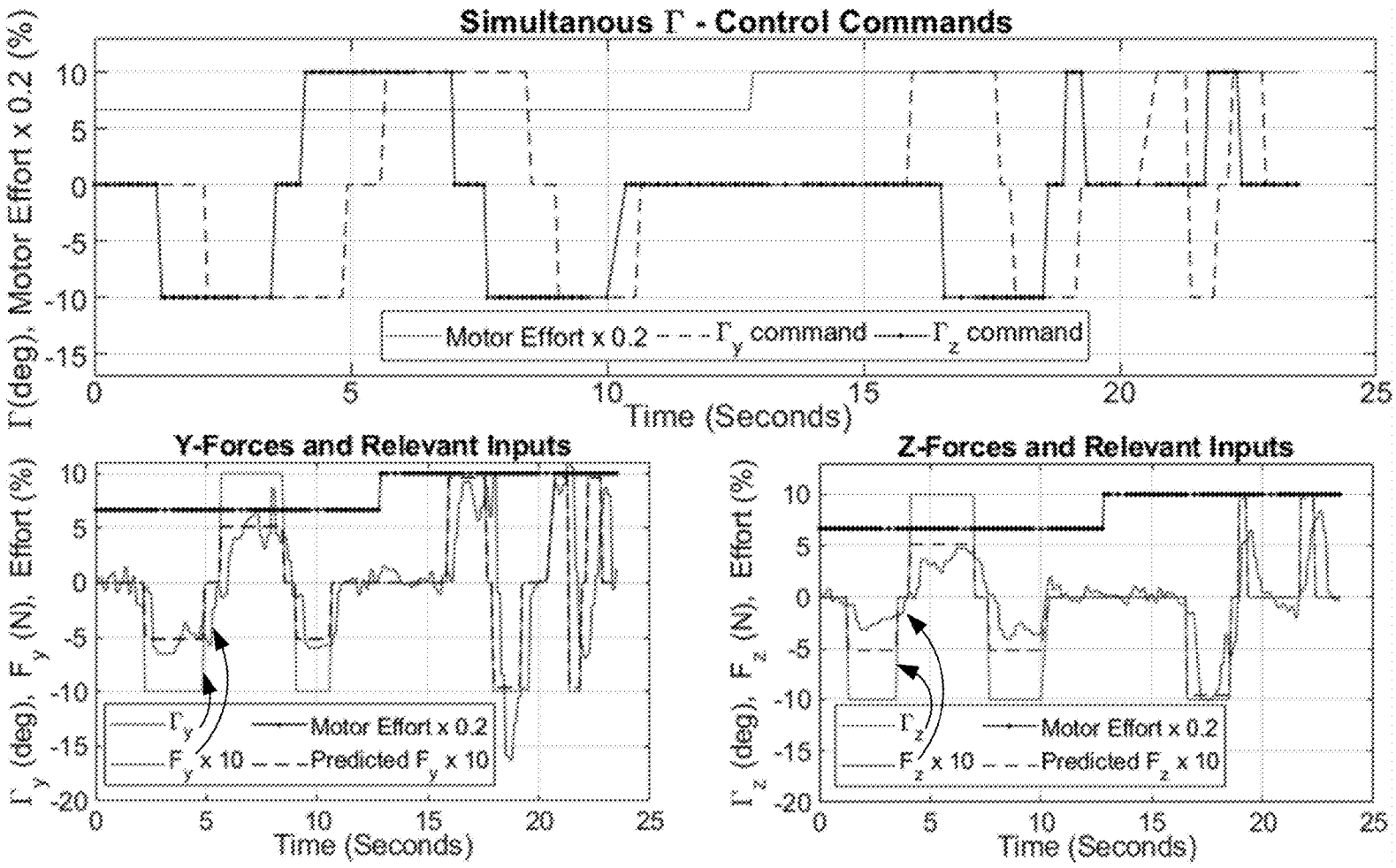
FIG. 16 illustrates example results of the simultaneous mixed-sway forces with $\Gamma \pm 10°$ according to various embodiments described herein.
Figure 17:
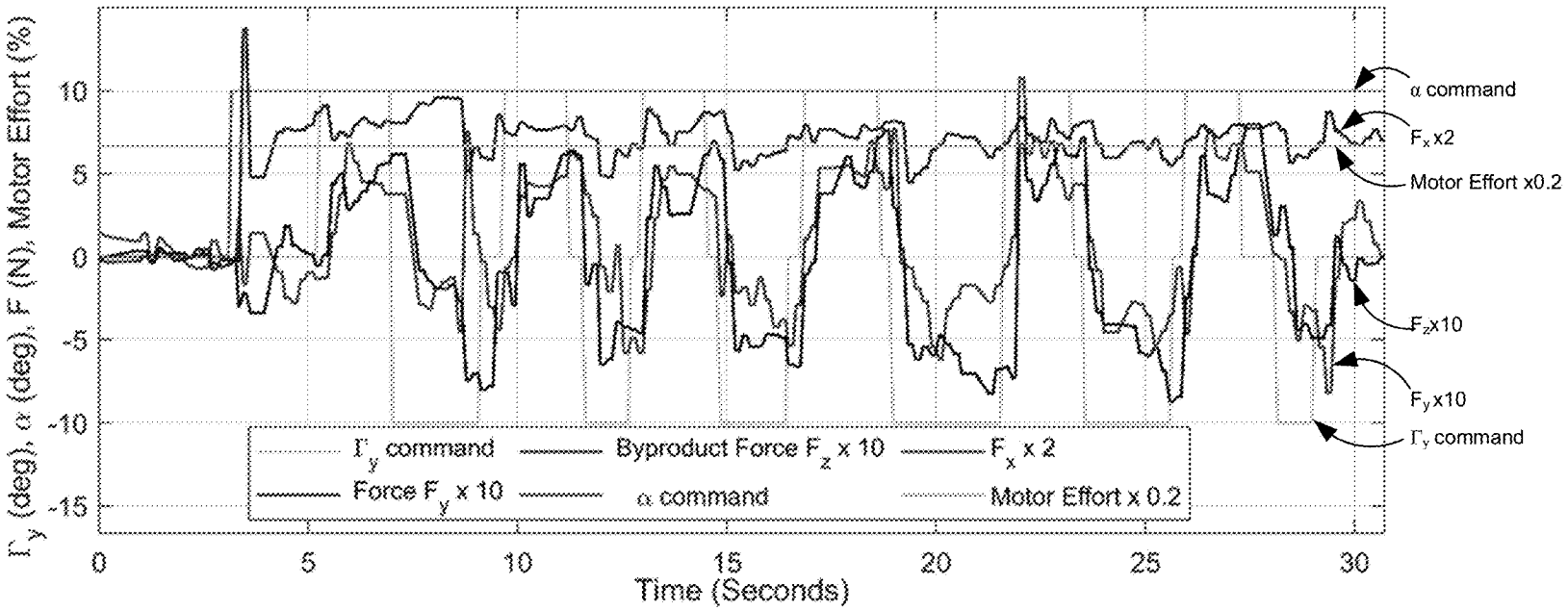
FIG. 17 illustrates example results of the cross-planar lateral-force coupling through simultaneous $\Gamma$ and $\alpha$ commands according to various embodiments described herein.

Simultaneous $\Gamma_y$ and $\Gamma_z$ maneuvers are shown to be achievable and decoupled in FIG. 16. The test was conducted with 33% and 50% motor effort at Γ-command magnitudes of only ±10°.

D. Control-Command Interactions

Control command combinations (α, β), and (β, Γ) were tested and confirmed to be decoupled. Testing of the combination (α, Γ) reveals some cross-planar coupling, which can be explained through blade drag analysis and then compensated for in a straightforward manner. Forces from an α+Γ test are presented in FIG. 17 which show the unwanted cross-planar interference, with the cross-planar lateral-force coupling through simultaneous Γ and α commands.

E. Compensation for α+Γ Cross-Planar Coupling

Figure 18:
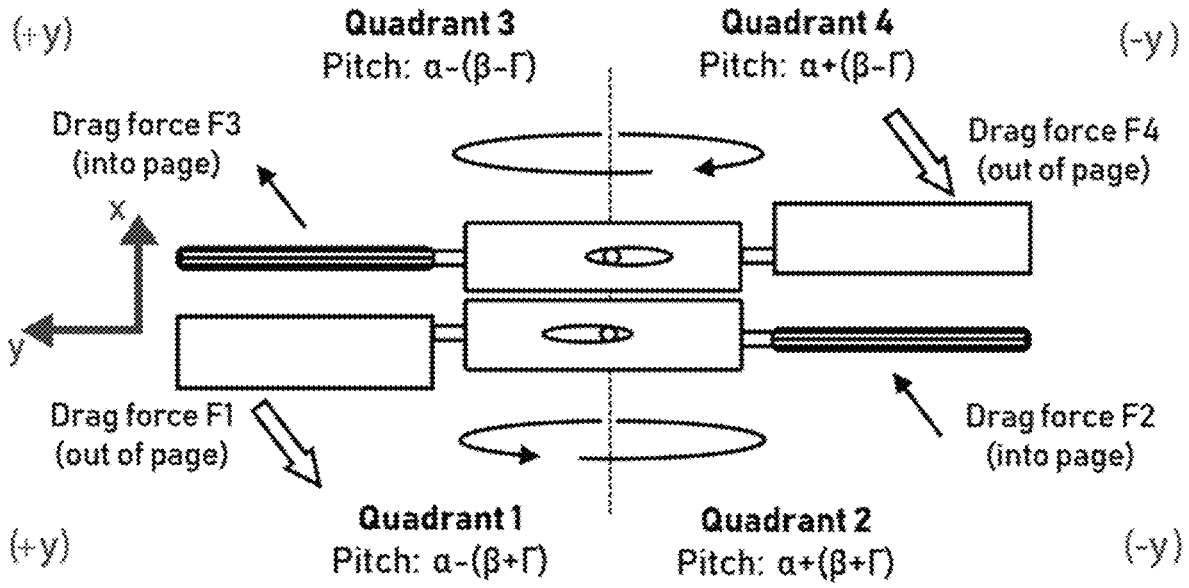
FIG. 18 illustrates a 2D representation of final blade angles with resulting drag forces according to various embodiments described herein.

Drag-forces on rotating blades can induce coupling between maneuvers on separate planes. FIG. 18 illustrates a 2D planar representation of blade angles with the total pitches of blades as they pass through four quadrants, as well as their respective drag forces into or out of the page. Blade drag projected from the xy-plane manifests as unwanted sway force in the xz-plane.

The total drag force into or out of the page is calculated with the understanding that drag scales with pitch angle squared. The total force into the page is then $$F_{tangential\ plane}=(F_2-F_1)-(F_4-F_3)$$

$$\propto((\alpha+(\beta+\Gamma))^2-(\alpha-(\beta+\Gamma))^2)-((\alpha+(\beta-\Gamma))^2-(\alpha-(\beta-\Gamma))^2)=8\alpha\Gamma\propto\alpha\Gamma \tag{5}$$

where the β command cancels out, ensuring that any unwanted cross-planar force is proportional only to the product of commands α and Γ and is independent of β.

As indicated above, it is possible to compensate for this unwanted cross-planar sway force through a Γ-sway command in the other plane. Recall that the command α is shared across all servos in both planes and motor effort is also shared everywhere. Any desired sway force $F_{wanted}=K_1\Gamma$ in one plane generates an unwanted byproduct sway force $F_{unwanted}=K_2\alpha\Gamma$ in the other. So long as the ratio between unwanted byproduct force and desired force $$\frac{K_2\alpha\Gamma}{K_1\Gamma} \triangleq K_3\alpha$$

is known, cross-planar coupling can be compensated for straightforwardly. The compensation process actually amplifies the desired sway forces generated, because the coupling only alters the effective direction of applied sway force while increasing its magnitude. For any desired commands $\Gamma_{y,\,des}$, $\Gamma_{z,\,des}$, and α, the final compensated sway commands $\Gamma_{y,\,fin}$ and $\Gamma_{z,\,fin}$ are derived through a system of equations linking the two planes $$\left.\begin{aligned} K_1\Gamma_{y,fin} - K_2\alpha\Gamma_{z,fin} &= K_1\Gamma_{y,des} \\ K_1\Gamma_{z,fin} + K_2\alpha\Gamma_{y,fin} &= K_1\Gamma_{z,des} \end{aligned}\right\} \begin{aligned} \Gamma_{y,fin} &= \frac{\Gamma_{y,des} + K_3\alpha\Gamma_{z,des}}{1+(K_3\alpha)^2} \\ \Gamma_{z,fin} &= \frac{\Gamma_{z,des} - K_3\alpha\Gamma_{y,des}}{1+(K_3\alpha)^2} \end{aligned} \tag{6}$$

effectively decoupling the two axes and eliminating cross-planar interference. From FIG. 24, $K_3$ is approximately $$0.1\frac{N}{(N-deg\alpha)}.$$

Final commands $\Gamma_{y,\,fin}$ and $\Gamma_{z,\,fin}$ are read directly to actuators through (2). Desired commands $\Gamma_{y,\,des}$ and $\Gamma_{z,\,des}$ are used for control and will be referred to as $\Gamma_y$ and $\Gamma_z$, respectively.

For the small-scale model operating at 50% motor effort, open-loop control parameters are mapped to forces and torques as follows:

$$\begin{bmatrix} F_x \\ F_y \\ F_z \\ T_x \\ T_y \\ T_z \end{bmatrix} = \begin{bmatrix} F_{surge} \\ F_{sway} \\ F_{heave} \\ T_{roll} \\ T_{pitch} \\ T_{yaw} \end{bmatrix} = \tag{7}$$

$$\begin{bmatrix} 8.9E^{-1} & 0 & 0 & 0 & 0 & 0 \\ 0 & 9.6E^{-2} & 0 & 0 & 0 & 0 \\ 0 & 0 & 9.6E^{-2} & 0 & 0 & 0 \\ 0 & 0 & 0 & 7.1E^{-4} & 0 & 0 \\ 0 & 0 & 0 & 0 & 2.2E^{-2} & 0 \\ 0 & 0 & 0 & 0 & 0 & 2.2E^{-2} \end{bmatrix} \begin{bmatrix} \alpha \\ \Gamma_y \\ \Gamma_z \\ \delta \\ \beta_y \\ \beta_z \end{bmatrix}$$

An omnidirectional vehicle is disclosed with speed and agility sufficient enough to work in turbulent environments inaccessible to traditional craft, as would be seen in many shallow marine environments that require inspection. The propulsor exploits properties emerging from continuous counter-rotating blades to generate near-instantaneous forces and moments in six degrees of freedom of considerable magnitude, and is designed to allow each DOF to be controlled independently by one of six decoupled control parameters. In the study, a small-scale model was built to verify different sets of maneuvers that would be used in the full-scale model. Slow-motion analysis confirms the instantaneous reaction time. The new method to generate lateral sway force underwater was originally simulated using STARCCM+CFD software. The propulsor can generate sway thrust at a magnitude near 10-20% surge thrust capability.

A straightforward method for reorienting lateral forces resulting from blade drag was presented, and a basic open-loop controller was designed linking all open-loop control parameters for surge, yaw, and roll to desired output forces and moments on the small-scale model. Omnidirectional ROV propulsion can be achieved through a fully-actuated counter-rotating blade mechanism to potential speeds well beyond anything achieved through traditional ROV thrusters, and can feasibly produce instantaneous sway force using this mechanism.

The above-described examples of the present disclosure are merely possible examples of implementations set forth for a clear understanding of the principles of the disclosure. Many variations and modifications can be made without departing substantially from the spirit and principles of the disclosure. All such modifications and variations are intended to be included herein within the scope of this disclosure and protected by the following claims.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

It is to be understood that, unless otherwise indicated, the present disclosure is not limited to particular materials, manufacturing processes, or the like, as such can vary. It is also to be understood that the terminology used herein is for purposes of describing particular embodiments only and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Therefore, the following is claimed:

1. A propulsion system, comprising:

two decoupled counter-rotating rotors centered on a main axis, each rotor comprising a plurality of pivotable blades projecting radially;

a blade-axis re-enforcing flap adapter comprising a plurality of stationary flaps, the blade-axis re-enforcing flap adapter being positioned in a region between the two decoupled counter-rotating rotors centered on the main axis;

two servo-swashplate actuation mechanisms positioned on opposing ends of the two decoupled counter-rotating rotors along the main axis, each servo-swashplate actuation mechanism comprising a plurality of servos and a linkage assembly connected from the servos to the pivotable blades; and a controller configured to:

calculate a plurality of control parameters;

compensate a first control parameter among the control parameters; and generate a control signal for each of the servos based on the control parameters.

2. The propulsion system of claim 1, wherein the plurality of control parameters comprise a surge control parameter $\alpha$, a yaw control parameter $\beta$, a sway control parameter $\Gamma$, and a roll control parameter $\delta$.

3. The propulsion system of claim 1, wherein the controller is configured to compensate the first control parameter to reduce cross-coupling of an unwanted force generated by drag forces on the two decoupled counter-rotating rotors.

4. The propulsion system of claim 1, wherein the controller is configured to compensate the first control parameter to reduce cross-coupling of an unwanted force due to a second control parameter.

5. The propulsion system of claim 4, wherein:

the first control parameter comprises a sway control parameter $\Gamma$;

the second control parameter comprises a surge control parameter $\alpha$; and the controller is configured to compensate the sway control parameter $\Gamma$ to reduce cross-coupling of an unwanted force due to the surge control parameter $\alpha$.

6. The propulsion system of claim 1, wherein the controller is configured to compensate the first control parameter to reduce cross-coupling of an unwanted force based on a ratio of the unwanted force to a desired force.

7. The propulsion system of claim 1, wherein the controller is configured to compensate the first control parameter to reduce cross-coupling of an unwanted force based on a system of equations linking two planes controlled by the servos.

8. The propulsion system of claim 1, wherein the blade-axis re-enforcing flap adapter comprises eight stationary flaps.

9. The propulsion system of claim 8, wherein the eight stationary flaps of the blade-axis re-enforcing flap adapter reduce flow leakage between high and low pressure regions in the region between the two decoupled counter-rotating rotors.

10. The propulsion system of claim 1, wherein the blade-axis re-enforcing flap adapter comprises more than eight stationary flaps.

11. The propulsion system of claim 1, wherein the stationary flaps of the blade-axis re-enforcing flap adapter reduce unwanted flow during a sway maneuver of the propulsion system.

12. The propulsion system of claim 1, wherein each servo among the plurality of servos controls a pitch of the pivotable blades passing through a particular quadrant.

13. A method of controlling a propulsion system, the propulsion system comprising:

two decoupled counter-rotating rotors centered on a main axis, each rotor comprising a plurality of pivotable blades projecting radially from the main axis;

a servo-swashplate actuation mechanism comprising a plurality of servos and a linkage assembly connected from the servos to the pivotable blades;

a blade-axis re-enforcing flap adapter comprising a plurality of stationary flaps, the blade-axis re-enforcing flap adapter being positioned in a region between the two decoupled counter-rotating rotors centered on the main axis; and a controller, wherein the method comprises:

calculating, by the controller, a plurality of control parameters;

compensating, by the controller, a first control parameter among the control parameters; and generating, by the controller, a control signal for each of the servos based on the control parameters.

14. The method of claim 13, wherein the plurality of control parameters comprise a surge control parameter $\alpha$, a yaw control parameter $\beta$, a sway control parameter $\Gamma$, and a roll control parameter $\delta$.

15. The method of claim 13, further comprising compensating, by the controller, the first control parameter to reduce cross-coupling of an unwanted force generated by drag forces on the two decoupled counter-rotating rotors.

16. The method of claim 13, further comprising compensating, by the controller, the first control parameter to reduce cross-coupling of an unwanted force due to a second control parameter.

17. The method of claim 16, wherein:

the first control parameter comprises a sway control parameter $\Gamma$;

the second control parameter comprises a surge control parameter $\alpha$; and the method further comprises compensating, by the controller, the sway control parameter $\Gamma$ to reduce cross-coupling of an unwanted force due to the surge control parameter $\alpha$.

18. The method of claim 13, further comprising compensating, by the controller, the first control parameter to reduce cross-coupling of an unwanted force based on a ratio of the unwanted force to a desired force.

19. The method of claim 13, further comprising compensating, by the controller, the first control parameter to reduce cross-coupling of an unwanted force based on a system of equations linking two planes controlled by the servos.

20. The method of claim 13, wherein:

the blade-axis re-enforcing flap adapter comprises eight stationary flaps; and the eight stationary flaps reduce unwanted flow during a sway maneuver of the propulsion system.

* * * * *